US009428932B2

(12) United States Patent
Daly

(10) Patent No.: US 9,428,932 B2
(45) Date of Patent: Aug. 30, 2016

(54) PORTABLE PERSONAL SEATING BARRIER

(71) Applicant: Sensory Shield, LLC, North Bethesda, MD (US)

(72) Inventor: Lisa Margaret Daly, North Bethesda, MD (US)

(73) Assignee: Sensory Shield LLC, North Bethesda, MD (US)

( * ) Notice: Subject to any disclaimer, the term of this patent is extended or adjusted under 35 U.S.C. 154(b) by 285 days.

(21) Appl. No.: 14/169,991

(22) Filed: Jan. 31, 2014

(65) Prior Publication Data

US 2015/0013737 A1 Jan. 15, 2015

Related U.S. Application Data

(63) Continuation-in-part of application No. 13/552,124, filed on Jul. 18, 2012, now abandoned.

(60) Provisional application No. 61/515,368, filed on Aug. 5, 2011, provisional application No. 61/909,532, filed on Nov. 27, 2013, provisional application No. 61/762,888, filed on Feb. 9, 2013.

(51) Int. Cl.

| | |
|---|---|
| ***E04H 15/42*** | (2006.01) |
| ***E04H 15/48*** | (2006.01) |
| ***A47C 7/62*** | (2006.01) |

(52) U.S. Cl.

CPC ..... *E04H 15/42* (2013.01); *A47C 7/62* (2013.01); *E04H 15/48* (2013.01)

(58) Field of Classification Search

CPC ..... E04H 15/42; E04H 15/48; A47C 7/62

USPC ..... 297/380, 252, 255, 180.14, 180.15; 135/143; 52/65

See application file for complete search history.

(56) References Cited

U.S. PATENT DOCUMENTS

| | | | | |
|---|---|---|---|---|
| 3,155,427 | A * | 11/1964 | Necessary | A47C 1/16 297/184.14 |
| 3,825,298 | A * | 7/1974 | Chipman | A47C 1/146 297/380 |
| 4,674,631 | A | 6/1987 | Williams | |
| 4,746,166 | A | 5/1988 | Sadan | |
| 5,123,707 | A | 6/1992 | Wurzell | |
| 5,190,344 | A | 3/1993 | Anderson et al. | |
| 5,205,610 | A * | 4/1993 | Reninger | A45C 9/00 297/380 |
| 5,460,426 | A | 10/1995 | Tribelsky et al. | |
| 5,524,915 | A | 6/1996 | Liu | |
| 5,564,777 | A | 10/1996 | Wild | |
| 5,971,487 | A | 10/1999 | Passehl | |
| 5,975,635 | A | 11/1999 | Parpala | |

(Continued)

*Primary Examiner* — Anthony D Barfield

(74) *Attorney, Agent, or Firm* — Eric L. Sophir; Dentons US LLP

(57) ABSTRACT

A portable personal seating barrier comprising of at least three poles and at least one panel, the barrier being capable of demarcating an individual seating space while also blocking out sensory stimuli from other people in close proximity and affording additional privacy to the user thereof. In certain embodiments, the panel retracts and expands telescopically, while in other embodiments the panel may be pleated or rolled around a core. This arrangement creates a portable device that can be used in a variety of settings, such as public buses, trains, airplanes, classrooms, and testing centers. The device can be free-standing and may not need to be physically attached to any structure, and thus provides a seat and a privacy/sensory barrier from others.

20 Claims, 14 Drawing Sheets

(56) References Cited

U.S. PATENT DOCUMENTS

| | | | | |
|---|---|---|---|---|
| 6,015,190 | A | 1/2000 | Wend | |
| 6,113,183 | A | 9/2000 | Koch et al. | |
| 6,142,574 | A | 11/2000 | Alexander | |
| 6,592,187 | B2 | 7/2003 | Calvery | |
| 6,644,736 | B2 | 11/2003 | Nguyen et al. | |
| 6,871,905 | B2 | 3/2005 | Grace | |
| 6,908,150 | B1 | 6/2005 | Wegner et al. | |
| 6,969,112 | B1 | 11/2005 | Sherrill | |
| 7,258,401 | B2 | 8/2007 | Smith | |
| 2005/0077014 | A1* | 4/2005 | Mark | A63B 71/022 160/135 X |
| 2011/0309658 | A1 | 12/2011 | Carimati Di Carimate et al. | |

* cited by examiner

PORTABLE PERSONAL SEATING BARRIER

This application is related to, claims the benefit of, and is a continuation-in-part of U.S. patent application Ser. No. 13/552,124, filed Jul. 18, 2012, entitled Portable Personal Seating Barrier, which claims the benefit of Provisional U.S. Patent Application No. 61/515,368, filed Aug. 5, 2011, the contents of which are incorporated herein by reference in their entirety. The instant application is also related to, and claims the benefit of, Provisional U.S. Patent Application Ser. No. 61/909,532, filed Nov. 27, 2013 and Provisional U.S. Patent Application Ser. No. 61/762,888, filed Feb. 9, 2013, the contents of which are incorporated herein by reference in their entirety.

FIELD

The instant application is directed to an article of manufacture, and manufacturing techniques related thereto, which provides additional privacy to, and reduces sensory stimulation experienced by, the user thereof. More particularly, the instant application describes a portable personal seating barrier and methods of manufacturing, distributing, operating, and using the same, which provides the user a barrier that can help increase privacy and reduce the amount of sensory stimulation experienced by the user, especially in a highly stimulative environment, such as, without limitation, in an airplane, subway, bus, or other form of mass transportation, or in a cafeteria, government office, classroom, testing environment, or the like.

BACKGROUND

Studies have shown that most people value their personal space, find physical proximity to be psychologically and in some cases physically disturbing and uncomfortable, and feel discomfort, anger, anxiety and other effects when their personal space is encroached or they are over stimulated because of crowded conditions. In addition, studies have shown that heart rate, blood pressure, and skin conductance increase when people are in crowded spaces or spaces that they anticipate will become crowded where they have little or no control over maintaining their personal space and level of stimulation. Public places are often crowded and are becoming more so. In public places where seating is available, individual seating spaces are often not demarcated or are demarcated but not physically divided. Often people will encroach into what is intended to be the space of the person seated next to them. Theatres, sporting events, institutions of formal education and testing, and governmental service locations are a few of the many examples of public places with crowded seating conditions.

Public transportation vehicles are also examples of public spaces that are often crowded, with crowded seating conditions. Subways, cars, airplanes, trains, buses, and other modes of public transportation often allow little space for each individual. For example, in many subway cars, the seats are of a bench style. Though each individual space is often marked in some manner, often no armrests, dividers, or barriers exist between individual seating spaces, or if they do, they are often inadequate to ensure that each person remains within one space and does not encroach physically, or in some other manner, on the space of the person beside them. One seated passenger may eat, engage in personal grooming, cough, sneeze, physically rub against, stare, and otherwise provide unwanted stimuli to the person beside whom they are seated. There have even been cases of passengers urinating on bench seats with the urine running onto the seat and person seated next to them and of passengers vomiting and bleeding on passengers seated beside them.

People with disorders or conditions (or both) that compromise the brain's ability to process and integrate certain information received from the body's five basic sensory systems can be especially impacted by having to sit in close proximity to others, in crowded situations, or both. Such sensory processing and integrative problems, comprising but not limited to learning disabilities, autism spectrum disorders, stress-related disorders, anxiety disorders, attention-deficit hyperactivity disorder, post-traumatic stress disorder, and brain injury are found in many children and adults. In some cases, people with at least one of these conditions or disorders are not capable of being in situations where the person is likely or certain to be in the conditions described above. This can mean that these people are unable to conduct certain activities, for example use public transportation. Because some of these people are also unable to drive or cannot afford to own a vehicle of their own, this lack of ability to have control over the proximity or stimulation in the crowded seating situation renders them without affordable, reliable transportation, greatly limiting their access to education, employment, and other societal necessities. Even people without these disorders and conditions may be sensitive to stimulation created by people in close physical proximity, even though some are not consciously aware of the effects.

SUMMARY

The instant disclosure is directed to various embodiments of a portable personal seating barrier. Some embodiments may comprise a personal barrier, the personal barrier comprising a rear horizontal support pole; a side horizontal support pole, the side horizontal support pole being hingedly attached to the rear horizontal support pole, the hinged attachment of the side horizontal support pole and the rear horizontal support pole allowing the rear horizontal support pole to rotate with respect to the side horizontal support pole and define a first plane, the first plane comprising a bottom of a space to be occupied by a user of the personal barrier; a vertical support pole, the vertical support pole being hingedly attached to the side horizontal support pole, the hinged attachment of the vertical support pole to the side horizontal support pole allowing the vertical support pole to rotate with respect to the side horizontal support pole to define a second plane, the second plane defining a first side of the space to be occupied by a user of the personal barrier; and a barrier comprising a fabric, the barrier being attached to the vertical support pole and the side horizontal support pole, the barrier occupying at least a portion of the first side. The hinged attachment of the vertical support pole to the side horizontal support pole may comprise an adjustable hinge (e.g., an adjustable barrel hinge) which allows the user to set the amount of friction provided by the hinge and/or the force necessary to cause the hinge to rotate. In some embodiments, the vertical support pole may comprise a plurality of sub-support poles, the sub-support poles being coupled by way of at least one of at least one hinge, magnetic coupling, telescopic connection, threaded coupling, or the like. The hinged attachment of the rear horizontal support pole to the side horizontal support pole may comprise at least one of a hinge, a pin, and a threaded coupling. By way of example, without limitation, the hinged attachment of the rear horizontal support pole to the side horizontal support pole may comprise a male component associated with one of the rear horizontal support pole and the side horizontal support pole, and a female component associated with the other of the rear horizontal support pole and the side horizontal support pole, and the male component and the female component may both be threaded.

In some embodiments, the fabric can be removably attached to at least one of the vertical support pole and the side horizontal support pole, such as, without limitation, by way of at least one of a tie, a snap, hook and loop fasteners, and buttons. The fabric may be pleated, folded, or otherwise easily collapsible so as to facilitate stowing of the personal barrier.

Although a variety of shapes and sizes are contemplated, in some embodiments, the rear horizontal support pole is between fourteen and twenty inches long, the vertical support pole is between twenty-four and thirty-six inches long, and the side horizontal support pole is between eighteen and twenty-four inches long.

In some embodiments, the hinged attachment of the vertical support pole to the side horizontal support pole allows the vertical support pole to be proximate to the side horizontal support pole when the personal barrier is in a stowed position, and the hinged attachment of the rear horizontal support pole to the side horizontal support pole allows the rear horizontal support pole to be proximate to the side horizontal support pole when the personal barrier is in the stowed position.

Other embodiments of the personal barrier comprise a rear horizontal support pole, the rear horizontal support pole being between fourteen and twenty inches long, between one half of an inch and two inches wide and between one quarter and one inch thick; a side horizontal support pole, the side horizontal support pole being between eighteen and twenty-four inches long, between one half of an inch and two inches wide and between one quarter and one inch thick; a first hinge, the first hinge being positioned near a first end of the rear horizontal support pole and a first end of the side horizontal support pole, the hinge allowing the rear horizontal support pole to rotate and define a first plane; a vertical support pole, the vertical support pole being between twenty-four and thirty-six inches long, between one half of an inch and two inches wide, and between one quarter of an inch and one inch thick; a second hinge, a first end of the second hinge being attached to the side horizontal support pole between two and six inches from the first hinge, a second end of the second hinge being attached to the vertical support pole, the hinge allowing the vertical support pole to rotate and define a second plane; and a fabric, a first end of the fabric being attached to the vertical support pole, and a second end of the fabric being attached to the side horizontal support pole, the fabric being pleated. The vertical support pole may comprise a plurality of sub-support poles, the sub-support poles being connected by a plurality of hinges, telescopic connection, magnetic coupling, threaded coupling, or the like. Each of the plurality of sub-support poles may be between twelve and eighteen inches long. The planes defined by the movement of the support poles relative to the side support pole may be perpendicular to each other.

The fabric can be removably attached to at least one of the vertical support pole and the side horizontal support pole, and may be treated with or made from a biologically inhibiting material.

In some embodiments, the personal seating barrier may comprise a plurality of support poles fixedly attached at or near a common end, the support poles defining at least three sides of a personal space for the user. In some embodiments, at least one of the at least three sides may comprise a panel. By way of example, without limitation, an embodiment may comprise at least two horizontal support poles, referred to as an upper horizontal support pole and a lower horizontal support pole, and at least one vertical support pole. In some embodiments, the poles may have a round cross-section. In some embodiments, the poles may have square, rectangular, hexagonal, pentagonal, oval, ellipsoid, or other cross-sections.

In some embodiments, the horizontal support poles may be joined at a common end. The common end may comprise an articulable joint, oriented to facilitate defining an axis of the user's personal space. Such a joint may be formed in a variety of manners, including, without limitation, by a pin held in place by friction, a screw threaded into one or both of the horizontal support poles, a hinge mated to the horizontal support poles, or the like. In some embodiments, at least one of the horizontal support poles may comprise a plurality of detents or other locking mechanisms which facilitate temporarily locking the horizontal support poles in the open or closed position. The vertical support pole can be mated to the upper horizontal support pole by a hinge. In some embodiments, the hinge may be a friction hinge which stays in a user-specified position until additional force is provided. In some embodiments, the upper horizontal support pole and/or the hinge may comprise a plurality of detents or other locking mechanisms which facilitate temporarily locking the vertical support pole in one of a set of pre-defined angles. The hinge may be affixed to the upper horizontal support pole and the vertical support pole through a variety of means, including, without limitation, by screws, adhesives, and molding the hinge into at least one of the poles.

According to some embodiments, the portable personal seating barrier may be configured to provide a vertical panel, the vertical panel supported by the vertical support pole and the upper horizontal support pole. The panel can be stored inside any of the horizontal poles or attached to at least one of those poles by many means that include, but are not limited to Velcro or other hook and loop style fasteners, buttons, snaps, and ties.

Panels can be of different materials, including but not limited to hybrid cloth, fabric, oil cloth, Tyvek, plastic, paper, or other material for hygienic, personalization, comfort, or other purposes.

The poles may be telescoping, one solid piece, or several pieces connected and may be made out of any material sufficient to provide support for the device.

In some embodiments, the dimensions of the portable personal seating barrier are such that the device may fit into commercial or public transit vehicles with ease. As will be understood by one of ordinary skill, such dimensions may vary.

While multiple embodiments of the portable personal seating barrier are disclosed herein, still other embodiments will become apparent to those skilled in the art from this detailed description. The portable personal seating barrier disclosed herein is capable of myriad modifications in various obvious aspects, all without departing from the spirit and scope of the disclosure. Accordingly, the drawings and descriptions are to be regarded as illustrative in nature and not restrictive.

DETAILED DESCRIPTION

The instant disclosure is directed to a portable personal seating barrier. Various embodiments thereof are described herein. The descriptions may include dimensions, tolerances, chemical formulae, or other specifications. Such specifications are intended to be illustrative and are not intended to limit the claimed invention(s) unless recited as part of the relevant claim(s). Terms such as substantially, relatively, and approximately, as used herein, are intended to allow for variations, such as, without limitation, those inherent in manufacturing tolerances or the like which do not depart from the spirit or the scope of the disclosure. In general, these terms are intended to allow for deviances of 15-20% of the specified values.

Figure 1:
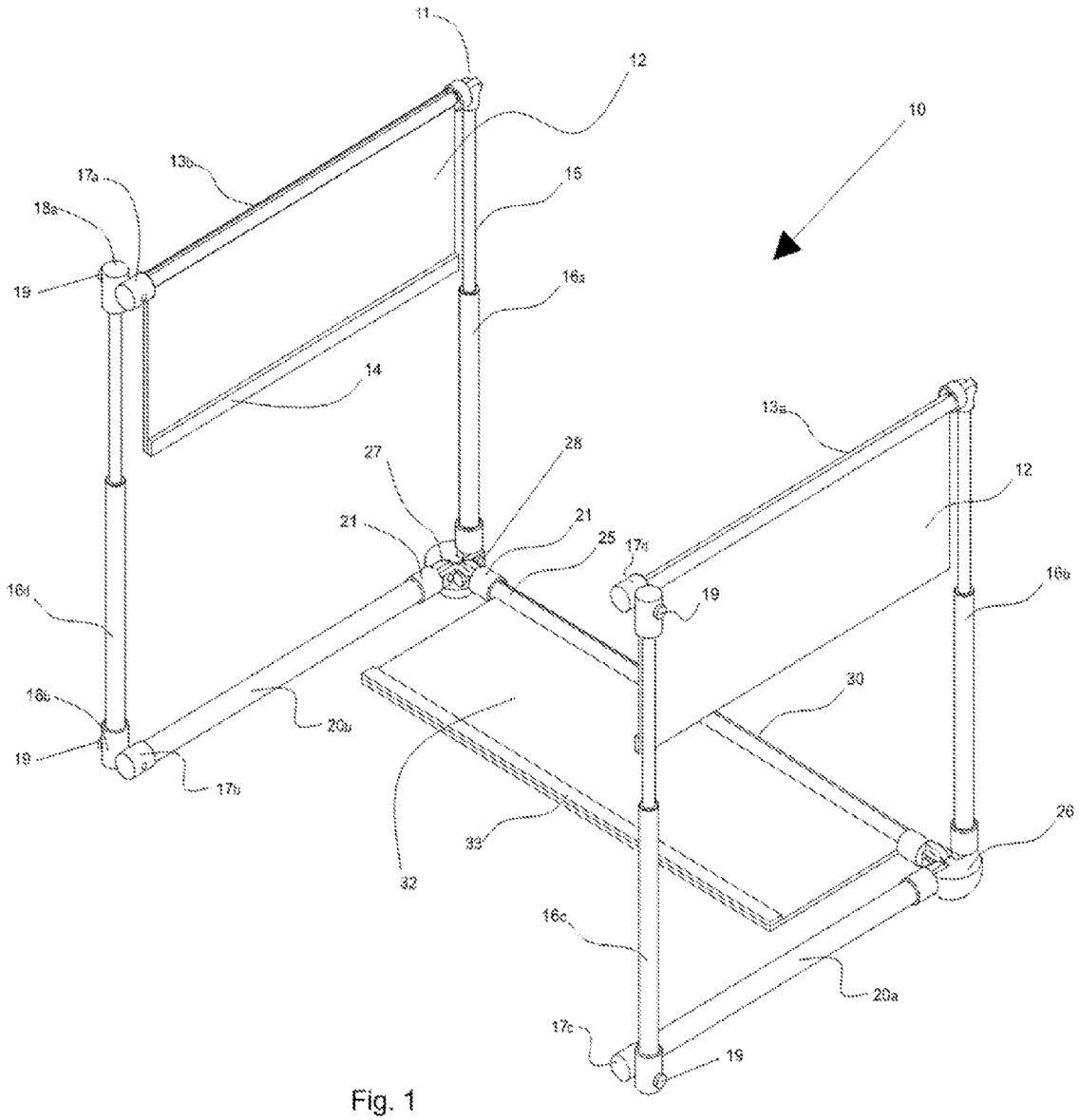
FIG. 1 is a perspective view of a portable personal seating barrier with nine support poles in a fully extended position, two vertical panels in a partially extended position, and one horizontal panel in a partially extended position, in accordance with an embodiment.

FIG. 1 is a perspective view illustrating an embodiment of barrier 10 in a partially deployed mode. As illustrated in FIG. 1, this embodiment comprises nine (9) support poles. In the illustrated embodiment, each of the support poles 30, 20*a*, 20*b*, 16*a*-16*d*, and 13 is a hollow tube having a circular cross-section, and each tube may be constructed of a variety of materials, including, without limitation, aluminum, polyvinyl chloride (PVC), carbon fiber, polycarbonate, or the like. In most embodiments it is advantageous for the material to be rigid enough to be self-supporting while light enough to allow barrier 10 to be easily transported. In some embodiments, support poles 30, 20*a*, 20*b*, 16*a*-16*d*, and 13 may be constructed of different materials. While hollow tubes made of a rigid material and having a circular cross-section are currently preferred for support poles 30, 20*a*, 20*b*, 16*a*-16*d*, and 13, solid tubes, such as, without limitation, tubes having a rectangular or elliptical cross-section, and tubes made of closed or open cell foam may be substituted therefor without departing from the spirit or the scope of the instant disclosure.

Figure 2:
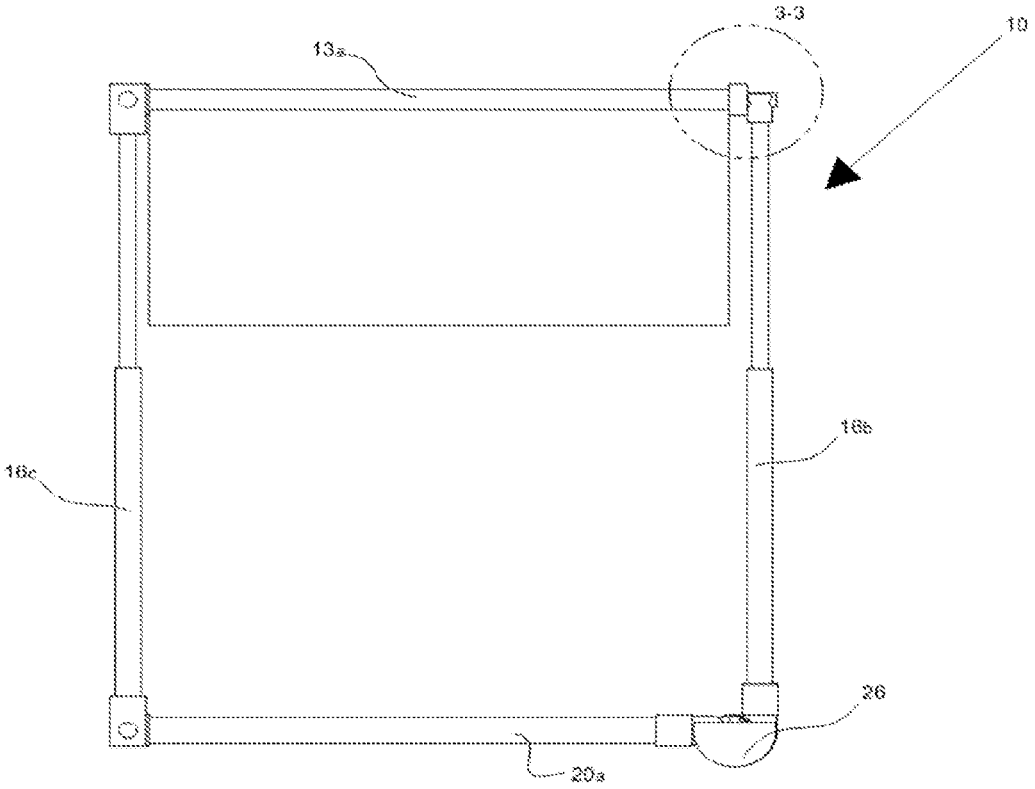
FIG. 2 is a side view of a portable personal seating barrier in an extended position in accordance with an embodiment.

The purpose of barrier 10 is to define a space which can be occupied by the user and which allows the user to restrict sensory feedback (e.g., visual, touch, and/or auditory feedback) received by the user and/or to provide the user with a sense of privacy. To define that space, barrier 10 comprises horizontal support poles 13, 20*a*, 20*b*, and 30, and vertical support poles 16. In the illustrated embodiment, the front of the space is left open to allow easy entry/exit by the user, although some embodiments allow a horizontal support pole similar to support pole 13 to be added across the front. The rear of the space defined by barrier 10 is further defined by horizontal support pole 30 and rear vertical support poles 16*a* and 16*b*. The left-hand side of the space, illustrated in more detail in FIG. 2, is defined by horizontal support poles 13*a* and 20*a*, and vertical support poles 16*b* and 16*c*. Similarly, the right-hand side of the space is defined by horizontal support poles 13*b* and 20*b*, and vertical support poles 16*a* and 16*d*. In the illustrated embodiment, the left-hand and right-hand sides are essentially mirror images of each other. In the illustrated embodiment, when fully extended or deployed, barrier 10 defines a space approximately sixteen to twenty inches wide, sixteen to twenty-four inches deep, and 24 to 36 inches high. As will be apparent based on the instant disclosure, the dimensions of the space defined by barrier 10 may vary without departing from the spirit or the scope of the disclosure.

Figure 3A:
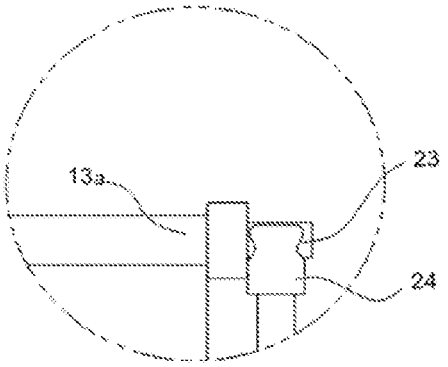
FIG. 3*a* is a detailed view of the attachment mechanism for the embodiment illustrated in FIG. 2.
Figure 3B:
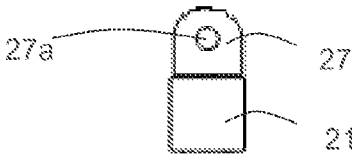
FIG. 3*b* is a detailed view of an end cap as used in FIG. 2.

In some cases, in addition to a desire to limit sensory stimulation and/or increase privacy, some users may also have concerns about hygiene, and the embodiment of barrier 10 illustrated in FIGS. 1-3 is designed to at least partially address those concerns. In the illustrated embodiment, horizontal support pole 30, which, in use, would typically rest near the rear of the seat occupied by the user, may comprise a slit or other void from which a fabric 32 can be extended when the use thereof is desired by the user. Although described as a fabric, other materials, including, without limitation, papers, sheets of plastic or flexible metal, or the like may be substituted therefor without departing from the spirit or the scope of the disclosed barrier.

In some embodiments, fabric 32 may be wound around a spring-loaded core, thereby allowing it to automatically retract when the user stands up or otherwise removes pressure from fabric 32. In some embodiments, fabric 32 may comprise a retaining strip or handle 33 at the free end thereof, which allows the user to easily grasp fabric 32, and which can also keep fabric 32 from fully retracting into horizontal support pole 30. In some embodiments, restraining strip 33 may mate with the front end of horizontal support poles 20*a* and 20*b*. By way of example, without limitation, retaining strip 33 may contain one or more rare earth magnets which mate with pins 19 or end caps 17 of horizontal support poles 20*a* and 20*b*. In other embodiments, the ends of restraining strip 33 may comprise one or more detents which can be slipped over the ends of pins 19. In still other embodiments, retaining strip 33 may comprise spring-loaded pins (not illustrated) which engage with detents (not illustrated) in end caps 17 but which can easily be disengaged therefrom so that the user can quickly stow barrier 10. In such embodiments, the spring-loaded core may not retract fabric 32 until the user disengages retaining strip 33 from such detents.

Although a spring-loaded core may be advantageous for facilitating the rapid stowing of barrier 10, in some embodiments (not illustrated) an end of fabric 32 may be mated with horizontal support pole 30. Such mating may be accomplished by way of adhesion, tying, Velcro or other hook and loop type fasteners, or other such manners. In such embodiments, horizontal support pole 30 may be captured by end caps 21 but end caps 21 may allow horizontal support pole 30 to longitudinally rotate therein, thereby allowing fabric 32 to be easily stowed by the user by wrapping fabric 32 around horizontal support pole 30. Other embodiments may include wheels or other such devices by which the user can cause a dowel or other rod within horizontal support pole 30 to rotate, thereby causing fabric 32 to retract into horizontal support pole 30.

In the illustrated embodiment, fabric 32 may be made from or treated with antibacterial, antimicrobial, antifungal, or other such biologically inhibiting materials, such as, without limitation, a coating of silver (including, without limitation, ionic silver, silver sodium hydrogen zirconium phosphate, silver nanoparticles, and the like), copper (including, without limitation, brasses, bronzes, cupronickel, copper-nickel-zinc, and the like), quaternary ammonium (including, without limitation, quaternary ammonium compound 3-(Trimethoxysilyl)-propyldimethyloctadecyl ammonium chloride (Si-QAC), and the like), antimicrobial peptides, chitin (including, without limitation, chitosan), chlorhexidine incorporated hydroxyapatite coatings, chlorhexidine-containing polylactide coatings on an anodized surface, and polymer and calcium phosphate coatings with chlorhexidine, titanium dioxide, zinc oxide, gallium, and the like.

Referring again to FIG. 1, horizontal support pole 30 can be hingedly attached to horizontal support poles 20*a* and 20*b*, and vertical support poles 16*a* and 16*b*, by way of hinges 26. Hinge 26 is designed so that the support poles, when barrier 10 is fully extended or deployed, maintain approximately right angles, or are perpendicular, to each other. In the illustrated embodiment, when vertical support poles 16*c* and 16*d* are removed (discussed below), hinge 26 allows horizontal support poles 20*b* and 30 to be folded so as to be proximate to vertical support pole 16*a*. Similarly, horizontal support pole 20*a* can be folded "up" to be proximate to vertical support pole 16*b*, and 20*a* and 16*b* can be folded to be proximate to horizontal support pole 30. In this manner, barrier 10 can be compactly stowed (e.g., for transportation) when vertical support poles 16*c* and 16*d* are detached therefrom.

As illustrated in FIG. 1, horizontal support pole 13*a* can be coupled to vertical support pole 16*b* by hinge 11, thereby allowing horizontal support pole 13*a* to be folded against or proximate to vertical support pole 16*b*. Similarly, horizontal support pole 13*b* can be coupled to vertical support pole 16*a*, thereby allowing horizontal support pole 13*b* to be folded against or proximate to vertical support pole 16*a*.

In some embodiments, such as those illustrated in FIGS. 2 and 3, a pin 23 or other extension near the end of horizontal support pole 13*a* can be mated with an end cap 24 which is sized to receive the pin. In still other embodiments, horizontal support pole 13*a* may mate with vertical support pole 16*b* by way of magnets embedded therein. It should be apparent to one skilled in the art that alternative attachment means can be substituted therefor without departing from the spirit or the scope of the disclosed barrier.

Referring again to FIG. 1, horizontal support poles 13*a* and 13*b* may comprise one or more fabrics 12*a* and 12*b*, respectively, which can be deployed to define the sides of the space which can be occupied by the user. In some embodiments, fabrics 12*a* and 12*b* may be made from material which is similar to or the same as fabric 32 described above, and may have retaining strip 14 which is similar to retaining strip 33 described above. Similarly, fabrics 12*a* and 12*b* may be deployed from and stowed around/within horizontal support poles 13*a* and 13*b* in manners analogous to those described above with respect to fabric 32 and horizontal support pole 30. For the purposes of brevity, the full recitation is not repeated herein.

In the embodiment illustrated in FIG. 1, horizontal support pole 13*b* further comprises an end cap 17*a*. End cap 17*a* may comprise at least one hole sized to receive a first pin 19 when first pin 19 is passed through end cap 18*a* of vertical support pole 16*d*. Similarly, end cap 17*b* of horizontal support pole 20*b* may comprise at least one hole sized to receive a second pin 19 when second pin 19 is passed through end cap 18*b* of vertical support pole 16*d*. Pins 19 allow the vertical support pole 16*d* to be easily attached to and detached from horizontal support poles 12*b* and 20*b*.

In the embodiment illustrated in FIG. 1, vertical support poles 16*a*, 16*b*, 16*c*, and 16*d* are designed to be height adjustable. In the illustrated embodiment, the height adjustment can be achieved by sliding sub-poles 15 within each of the vertical support poles 16. In the illustrated embodiment, sub-poles 15 are sized to fit snugly within their respective vertical support poles, thereby allowing the user to adjust the total height of barrier 10 by way of friction. In other embodiments, barrier 10 may be of a fixed height, in which case sub-poles 15 can be removed. In still other embodiments, sub-poles 15 may engage with their respective vertical support poles 16 by way of spring-loaded pins contained in the sub-poles 15 which engage in detents in the respective vertical support poles 16. In still other embodiments (not illustrated), vertical support poles 16 may comprise a cap which, when rotated, applies friction to sub-poles 15, thereby temporarily locking sub-poles 15 at a particular height. It should be apparent to one skilled in the art that other means for adjusting the height of barrier 10 can be substituted for those described above without departing from the sprit or the scope of the disclosed barrier.

In the embodiment illustrated in FIGS. 1-3*b*, hinge 26 comprises three end caps 21 which are mated to the hinge base 26 by way of pins 28. Each of end caps 21 comprises an extension 27 with a hole 27*a* sized to receive pin 28 and to allow pin 28 to mate with hinge base 26. In some embodiments, one of hinge base 26 and hole 27*a* may be threaded, with the other of hinge base 26 and hole 27*a* comprising a hole which is slightly oversized, thereby allowing a threaded pin to be passed therethrough and to mate with the threaded component. In still other embodiments, pin 28 may comprise a head to keep pin 28 from passing through the hole(s) in hinge base 26 and extension 27, and pin 28 may comprise threads at the end opposite the head by not proximate to the head. In such an embodiment, at least one of hole 27*a* and hinge base 26 may be threaded to receive the threads on pin 28, while still allowing the other component to rotate freely around the non-threaded portion of pin 28.

In some embodiments, hinge base 26 may be made of a variety of materials including, without limitation, plastics, acrylics, and metals based on the anticipated use of the particular barrier. By way of example, without limitation, although barrier 10 is described herein as being designed for use in a vehicle, barrier 10 could also be used in schools or offices where the user may desire privacy or to otherwise reduce sensory stimulation. In an embodiment meant for use in schools, where barrier 10 is not intended to be transported very often, it may be advantageous to manufacture at least one of hinge base 26, end caps 21, and/or pin 28 out of aluminum or another metal due to the impact and wear resistance inherent in such materials. While such metals may be advantageous for school use, the overall weight of barrier 10 may be significantly increased by the use of such materials, thus rendering the materials less desirable for use in a version of barrier 10 which is meant to be carried or otherwise transported regularly. In such embodiments, at least one of hinge base 26, end caps 21, and/or pin 28 may be made of an injection-molded or rotomolded plastic, which may decrease the overall weight of barrier 10. Some embodiments may also include snaps, hook and loop attachments, straps, clamps, pins, or other such mechanisms for providing a more permanent attachment of barrier 10 to the seat or other object on which it is deployed.

The preceding paragraphs define the right-hand side of barrier 10 when viewed from the perspective of a user occupying the space defined by the barrier. The left-hand side, which comprises horizontal support poles 13*a* and 20*a*, vertical support poles 16*b* and 16*c*, end caps 17*c* and 17*d*, pins 19, and fabric 12, is essentially a mirror image of the right-hand side, and for the purposes of brevity the description thereof is omitted.

Figure 4:
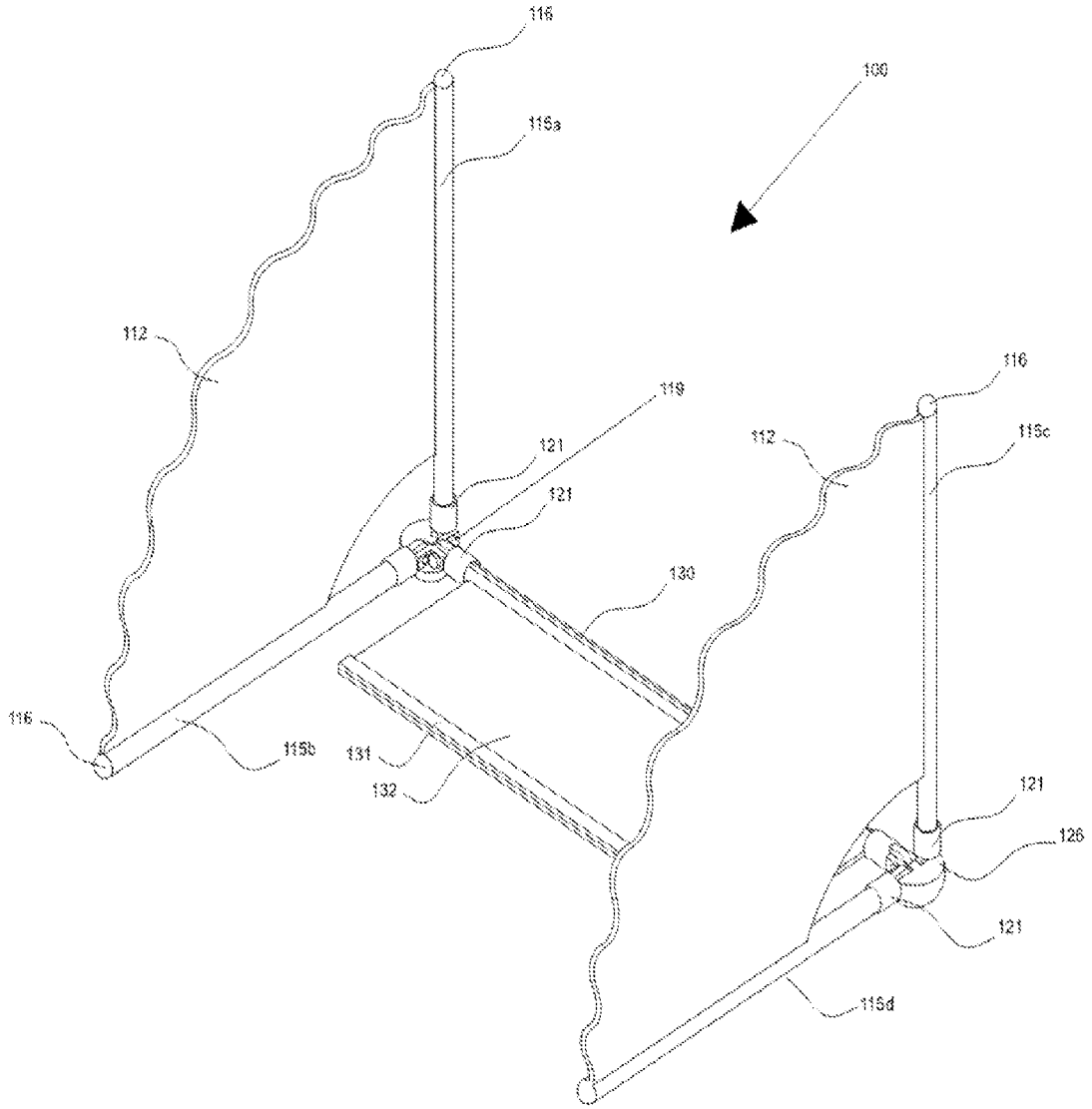
FIG. 4 is a perspective view of a portable personal seating barrier with five support poles in an extended position in accordance with an embodiment.
Figure 5:
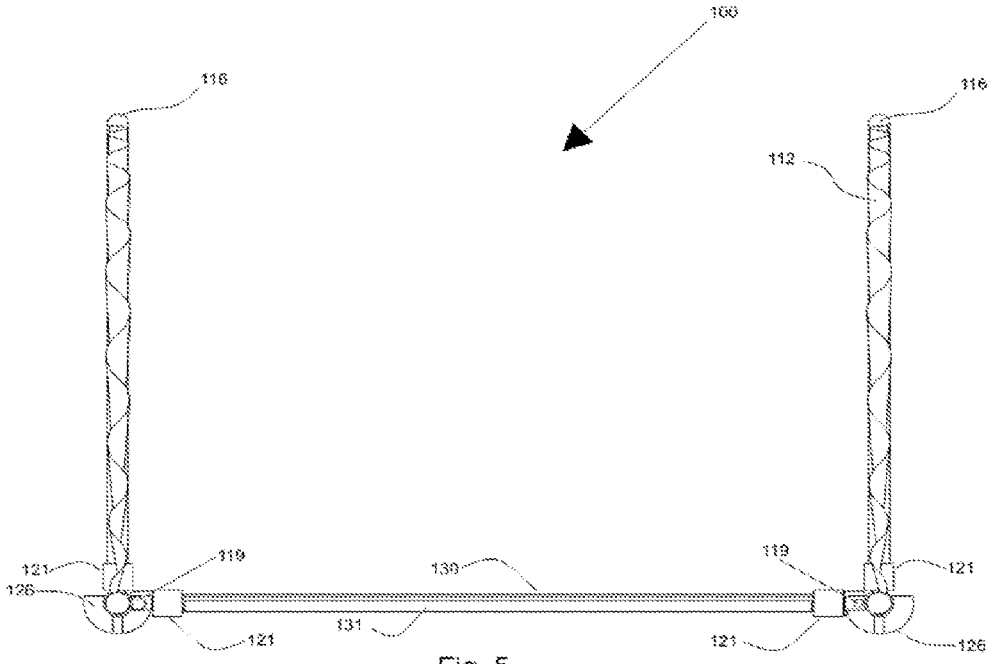
FIG. 5 is a front view of a portable personal seating barrier illustrated in FIG. 4.
Figure 6:
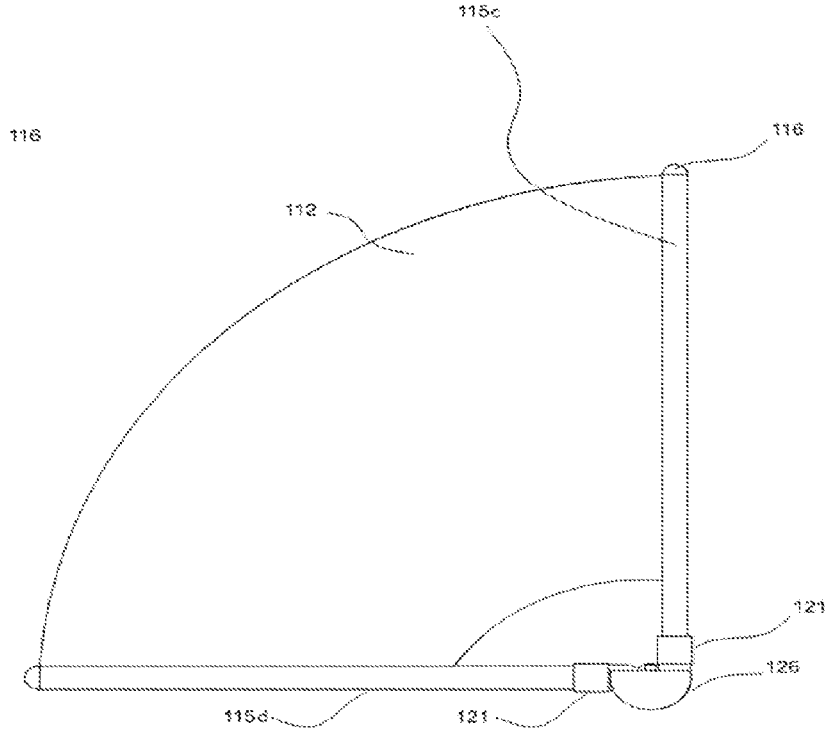
FIG. 6 is a side view of a portable personal seating barrier illustrated in FIG. 4.

FIGS. 4-6 illustrate an alternative embodiment of a personal barrier. FIG. 4 is a perspective view illustrating an embodiment of barrier 100 in a partially deployed mode. As illustrated in FIG. 4, this embodiment comprises five (5) support poles. In the illustrated embodiment, each of the support poles 115*a*, 115*b*, 115*c*, 115*d*, and 130 is a hollow tube, and each tube may be constructed of a variety of materials as discussed above with reference to the embodiment illustrated in FIG. 1.

The purpose of barrier 100 is to define a space which can be occupied by the user and which allows the user to restrict sensory feedback received by the user. To define that space, barrier 100 comprises horizontal support poles 115*b*, 115*d*, and 130, and vertical support poles 115*a* and 115*c*. In the illustrated embodiment, the front of the space is left open to allow easy entry/exit by the user. The rear of the space defined by barrier 100 is defined by horizontal support pole 130 and vertical support poles 115*a* and 115*c*. The left-hand side of the space, illustrated in more detail in FIG. 6, is defined by horizontal support 115*d* and vertical support poles 115*c*. Similarly, the right-hand side of the space is defined by horizontal support pole 115*b* and vertical support pole 115*a*. In the illustrated embodiment, height, width and depth of the space defined by barrier 100 are similar to the height, width, and depth associated with barrier 10. The left-hand and right-hand sides are essentially mirror images of each other.

In some cases, in addition to a desire to limit sensory stimulation, some users may also have concerns about hygiene, and the embodiment of barrier 100 illustrated in FIGS. 4-6 is designed to at least partially address those concerns. In the illustrated embodiment, horizontal support pole 130, which, in use, would typically rest at the base of the seat occupied by the user, may comprise a slit or other void from which a fabric 132 can be extended when the use thereof is desired by the user. Although described as a fabric, other materials, including, without limitation, sheets of paper, plastic, metal, or the like may be substituted therefor without departing from the spirit or the scope of the disclosed barrier. In the illustrated embodiment, fabric 132 may be stored within horizontal support pole 130 in a manner similar to the way fabric 32 is stored within horizontal support pole 30 of the embodiment illustrated in FIGS. 1-3. Fabric 132 may be withdrawn from, and/or reinserted into, horizontal support pole by way of retaining strip 131. The function of retaining strip 131 is similar to that described above with respect to retaining strip 33 in the embodiment illustrated in FIGS. 1-3. As described above with respect to fabric 32, fabric 132 may be made from or treated with biologically inhibiting materials.

Referring again to FIGS. 4-6, horizontal support pole 130 can be hingedly attached to horizontal support poles 115*b* and 115*d*, and vertical support poles 115*a* and 115*c*, by way of hinges 126. In the illustrated embodiment, horizontal support poles 115*b* and 115*d* can be folded so as to be proximate to vertical support poles 115*a* and 115*d*, respectively. Similarly, horizontal support pole 130 can be folded "up" to be proximate to vertical support poles 115*a* and 115*c*. In this manner, barrier 100 can be compactly stowed for transportation. Hinge 126 and the end caps 121 mated thereto which couple the support poles to hinge 126 may be similar to those described above with respect to hinge 26 of the embodiment illustrated in FIGS. 1-3.

Referring again to FIG. 4, fabrics 112 may be used to define the sides of the space to be occupied by the user. In the illustrated embodiment, fabrics 112 may be pleated, folded, or otherwise constructed so as to simplify stowing and deploying of the sides. In some embodiments, fabrics 112 may be made from material which is similar to or the same as fabric 132 described above. For the purposes of brevity, the full description of fabrics 112 is not repeated herein.

In the embodiment illustrated in FIGS. 4-6, support poles 115*a*, 115*b*, 115*c*, and 115*d* further comprise an end cap 116. In the illustrated embodiment, end caps 116 can be rounded over or otherwise blunted, thereby reducing the likelihood of injury to the user or the occupant of an adjacent seat in the event the accidentally come in contact with an end cap 116. Although illustrated herein as an end cap, in some embodiments the ends of support poles 115*a*-115*d* may be machined, cast, 3-D printed, or otherwise manufactured to be blunted, thereby obviating the need for an end cap.

The preceding paragraphs define the left-hand side of barrier 100 when viewed from the perspective of a user occupying the space defined by the barrier. The right-hand side is essentially a mirror image of the left-hand side, and for the purposes of brevity the description thereof is omitted.

Figure 7:
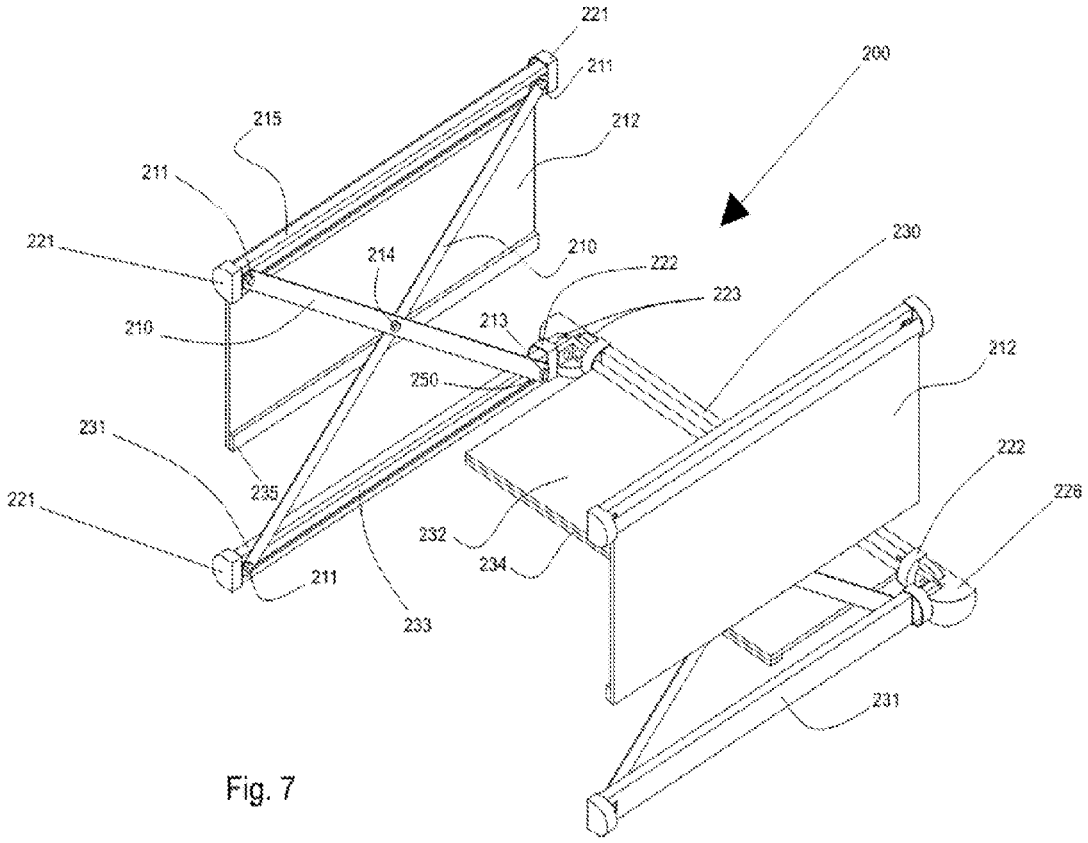
FIG. 7 is a perspective view of a portable personal seating barrier embodiment with sliding, adjustable supports in an extended position.
Figure 9:
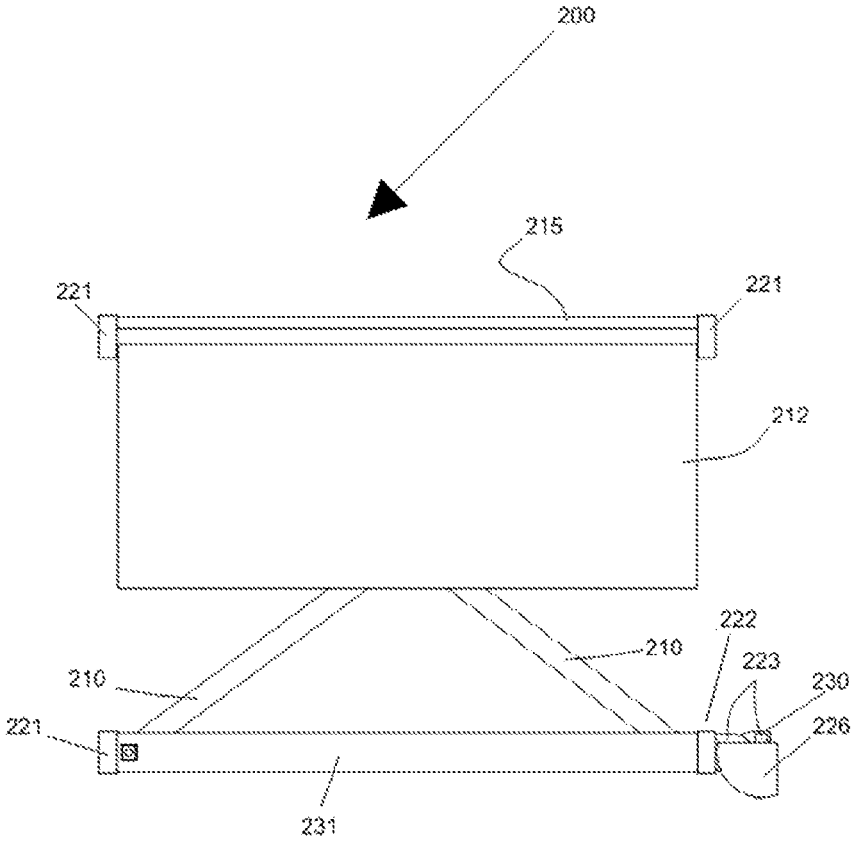
FIG. 9 is a side view of the portable personal seating barrier of FIG. 7.
Figure 8:
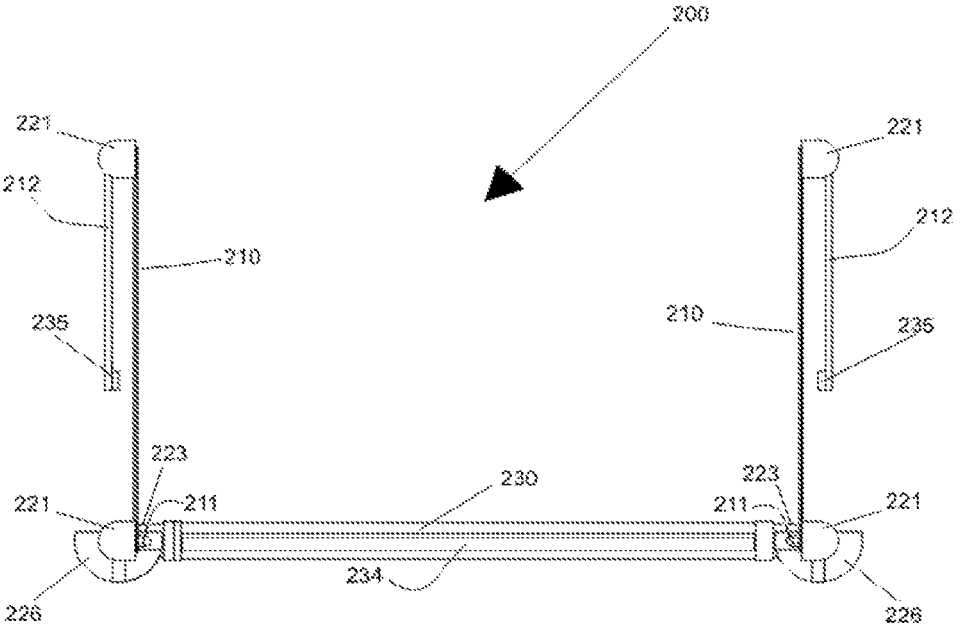
FIG. 8 is a front view of the portable personal seating barrier of FIG. 7.
Figure 10:
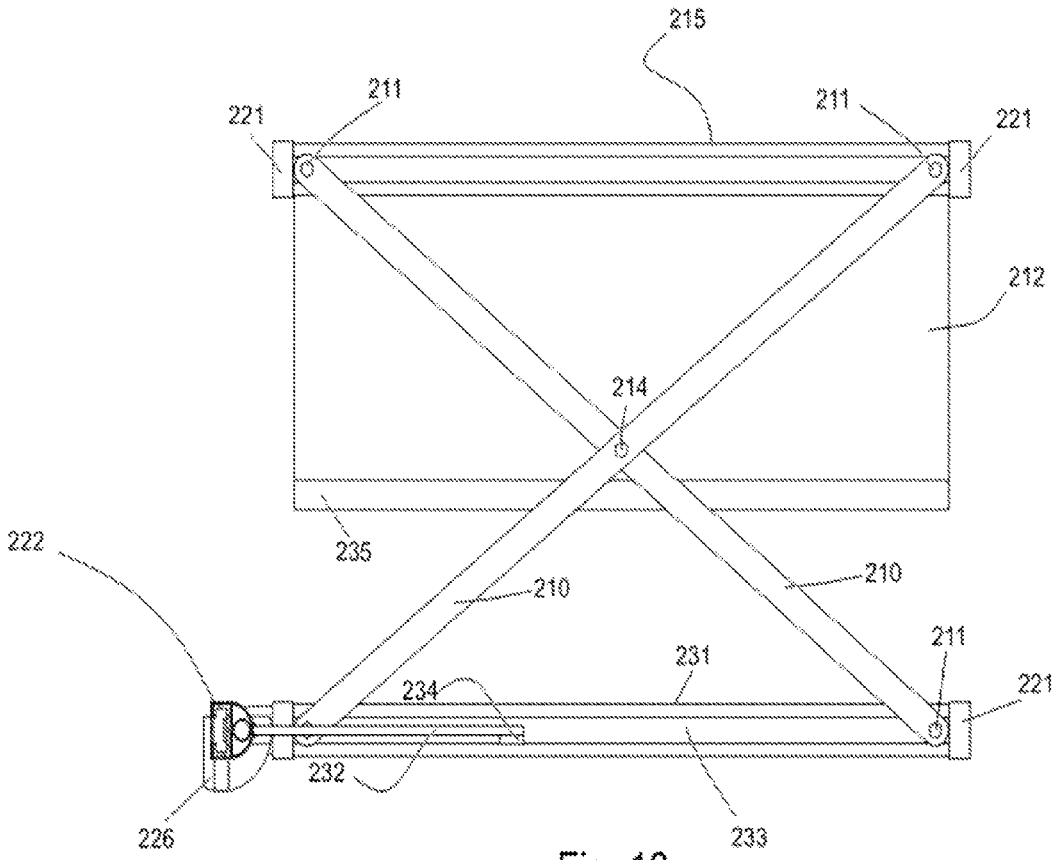
FIG. 10 is a cut-away side view of the portable personal seating barrier of FIG. 7.

FIGS. 7-10 illustrate an alternative embodiment of a portable personal seating barrier 200. FIG. 7 is a perspective view of barrier 200 in a partially deployed mode. FIG. 8 is a front view of barrier 200. FIG. 9 is a left-hand side view of barrier 200. FIG. 10 is a partial cut-away of barrier 200 illustrating the inside of the left-hand panel of FIG. 9. In the embodiment illustrated in these figures, a space is defined at the base by rear horizontal support pole 230 and left-hand and right-hand lower horizontal support poles 231. In use, rear horizontal support pole 230 is typically placed at the back of the seat, proximate to the user's back or buttocks. Rear horizontal support pole 230 may be made of metal, such as aluminum, stainless steel, or the like; plastic, including polyvinyl chloride, polyethylene, or the like; or other materials. In embodiments intended to be frequently moved, lighter weight materials, such as aluminum or plastics, may be preferable.

In the illustrated embodiment, rear horizontal support pole 230 comprises a support pole with end caps 222 at the ends thereof. In addition to rabbets, mortises, or the like capable of receiving or otherwise mating with the support pole, the inner surface of each end cap 222 also includes a mating surface capable of capturing at least a portion of a spring-tensioned roller around which fabric 232 is wound. For the purposes of brevity, a description of fabric 232 is not reproduced here, however fabric 232 may be similar to fabrics 32 and 132, described above. Fabric 232 may include a handle 234 or other such device which simplifies retrieval of fabric 232 when the user wishes to deploy the fabric. Although illustrated with a spring-tensioned roller, other means for controlling and managing fabric 232 may be substituted therefor without departing from the spirit or the scope of the disclosure. By way of example, without limitation, end cap 222 may allow the roller to rotate loosely therein, thereby allowing the user to roll and unroll the fabric without reliance on spring tension.

The outer surface of each end cap 222 may include a tab 223 or other such protrusion which is designed to allow the end cap to be mated to hinge body 226. In the illustrated embodiment, hinge body 226 has a shape which is approximately a quarter of a sphere. The flat edges of the shape are positioned to face the top of the space defined by barrier 200 and the rear of said space. The top, flat edge of hinge body 226 has been cut away, leaving an approximately right-angle void therein. Tab 223 of one of the end caps of horizontal support pole 230 is placed against one edge of the void in hinge body 226, and a pin is passed through the hole in tab 223 and into the wall of the void in hinge body 226. This pin can serve as a hinge and forms an axis around which horizontal support pole 230 can be rotated with respect to hinge body 226. Although described above as cut away, it should be apparent to one skilled in the art that the void in hinge body 226 may be formed during the manufacturing process, such as, without limitation, by being inherently cast into hinge body 226. As with rear horizontal support pole 230, hinge body 226, end caps 222, and the pins used to attach tabs 223 to hinge body 226 may be made from a variety of materials, including, without limitation, metals and plastics.

In the illustrated embodiment, left-hand and right-hand lower horizontal support poles 231 comprise a plurality of pieces of extruded "C" channel wherein members of the plurality are sized to fit within each other with enough clearance to allow the channels to slide freely while still remaining contained inside the outermost C channel. By way of example, without limitation, conventional curtain rods are typically manufactured as two pieces of extruded C channel which freely slide within each other. Although the illustrated embodiment uses an extruded C channel, alternative methods for manufacturing the C channel may be used to create horizontal support poles 231 without departing from the spirit or the scope of the disclosure.

An end cap 222 is attached to an end of the outermost C channel and allows that end to be hingedly coupled to hinge body 226. An end cap 221 is attached to the innermost C channel. In some embodiments, a spring 250 may be housed within the innermost C channel and attached to the insides of the end caps, the spring designed to put pressure on the C channels, by way of the end caps, so as to pull the outermost C channel until the end without end cap 222 is proximate to end cap 221. When in this position, the sides of barrier 200 are at their fullest extension. Although described above as comprising a shape similar to an extruded C channel, it should be apparent to one skilled in the art that alternative materials and shapes may be substituted therefor without departing from the spirit or the scope of the disclosure. By way of example, without limitation, hollow pipe, such as pipe made from PVC, may be used.

When in their fullest extension, the sides of barrier 200 are defined at the bottom by lower horizontal support poles 231, and at the top by upper horizontal support poles 215. In the illustrated embodiment, upper horizontal support poles 215 are manufactured to be similar to lower horizontal support poles 231, except that the end cap at the back of barrier 200 is an end cap 221, as opposed to an end cap 221. In some embodiments, upper horizontal support poles 215 may not include the spring described above as part of lower horizontal support poles 231.

In the embodiment illustrated in FIGS. 7-9, upper horizontal support poles 215 are supported by struts 211. Struts 211 are arranged to form an X, with an end of one of the struts positioned near the forward end of an upper horizontal support pole 215, and the other end of that strut positioned near the rear end of lower horizontal support pole 231 underneath the upper horizontal support pole. Similarly, the other strut is arranged with an end thereof positioned near the forward end of a lower horizontal support pole 231 and the other end of the strut positioned near the rear end of the upper horizontal support pole 215 above the lower horizontal support pole. In the illustrated embodiment, the struts are attached by way of screws 211, although alternative embodiments use other attachment mechanisms. At the intersection of the two struts, a pin or other hinge 214 may be inserted so as to improve the rigidity of the wall created by the struts and to couple the struts on a given wall so that they move essentially in unison.

Although struts 210 may create enough of a barrier on their own to reduce sensory stimulation, the illustrated embodiment also includes retractable fabric panels 212 with integrated handles 235. As with the fabric panels of the embodiment illustrated in FIG. 1 and described above, these fabric panels can be wound around a spring-loaded core and deployed to enhance the user's privacy, further reduce the likelihood of unwanted sensory stimulation, or other such purposes. The panels being similar to those described above, for the purposes of brevity a full description of the panels is not repeated here.

If the user wishes to close one or both sides, the user simply applies pressure to the appropriate upper horizontal support pole 215. When the desired upper horizontal support pole 215 is lowered so as to be proximate to the corresponding horizontal support pole 231, the lateral forces applied by struts 210 may be sufficient to lock the side in the closed position. In some embodiments, additional or alternative closure mechanisms may be used to keep the side in the closed position. By way of example, without limitation, such closure mechanisms may include snaps, ties, hook and loop closures, magnets, and the like.

Figure 11:
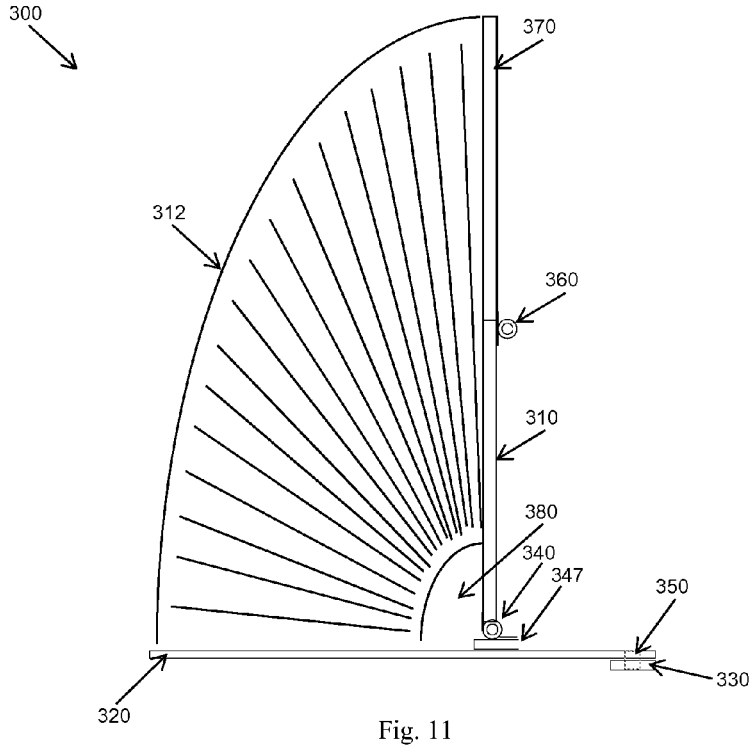
FIG. 11 is a side view of a portable personal seating barrier with three support poles in a fully extended position, in accordance with an embodiment.
Figure 12:
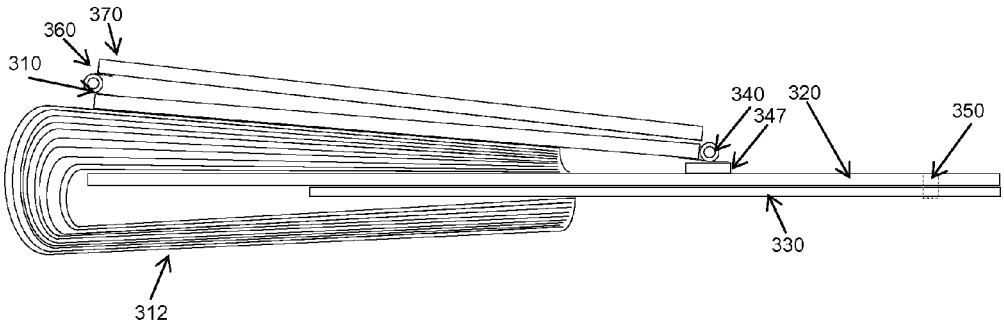
FIG. 12 is a side view of the portable personal seating barrier of FIG. 11 in a closed position.
Figure 13:
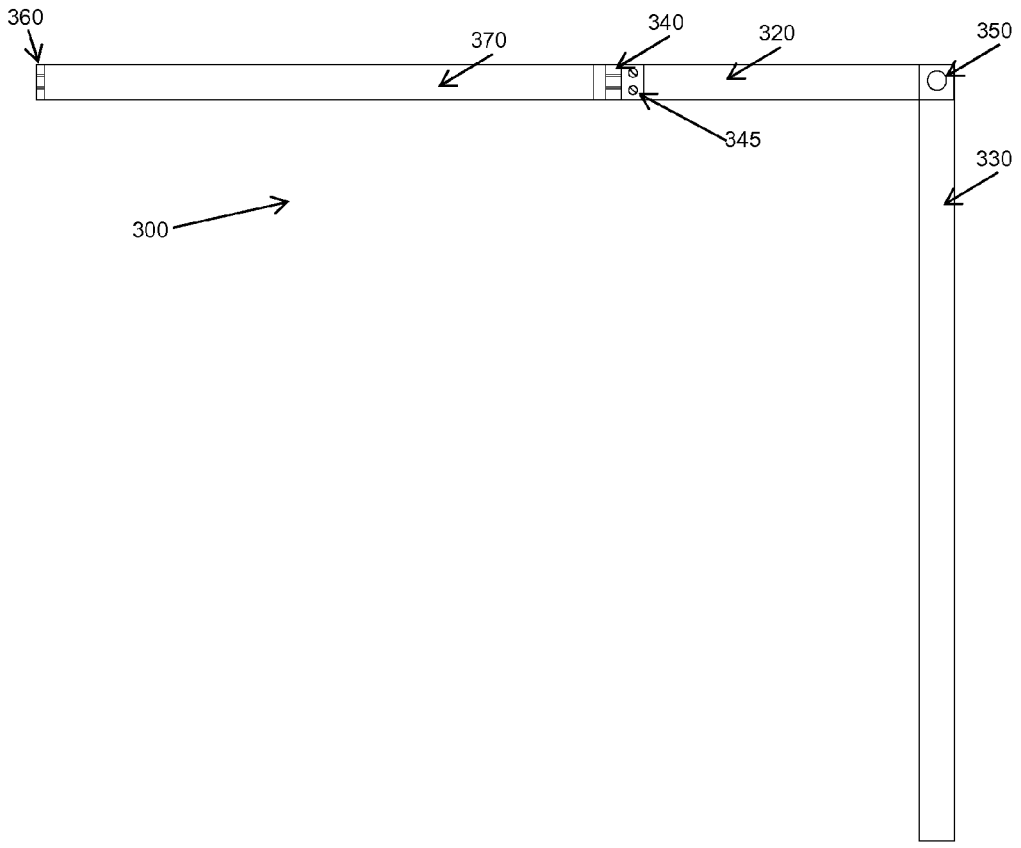
FIG. 13 is a top view of the portable personal seating barrier of FIG. 11 in a partially closed position.

FIGS. 11-13 illustrate an alternative barrier 300. FIG. 11 is a side view of barrier 300 when fully deployed. FIG. 12 is a side view of barrier 300 when collapsed. FIG. 13 is a top view of barrier 300 when partially collapsed. In the illustrated embodiment, fan 300 comprises a rear horizontal support pole 330, a side horizontal support pole 320, and a vertical support pole which comprises upper vertical support pole 370 and lower vertical support pole 310. In the illustrated embodiment, lower support pole is mated to upper support pole 370 by way of hinge 360. Although illustrated as comprising a plurality of sub-poles, some embodiments employ a solid vertical support pole in lieu thereof.

In the illustrated embodiment, each of rear horizontal support pole 330, side horizontal support pole 320, upper vertical support pole 370 and lower vertical support pole 310 (also referred to herein collectively as the support poles), and spacer block 347 each comprises impact resistant polyethylene which is between one half and two inches wide and between one quarter of an inch and one inch thick. Upper vertical support pole 370 and lower vertical support pole 310 are typically between twelve (12) and eighteen (18) inches long. Although specific materials having specific widths and thicknesses are given, the use of alternative materials, such as, without limitation, PVC, titanium, ultra-high molecular weight ("UHMW") plastic, aluminum, or the like, and components having different dimensions, are contemplated and intended to be part of the spirit and the scope of the disclosure. Similarly, although the support poles are illustrated as solid bars, hollow bars, solid rods, hollow tubes, or the like may be substituted therefor without departing from the spirit or the scope of the disclosure.

In the illustrated embodiment, a hole or other recess is drilled, machined, 3-D printed, cast, molded into, or otherwise made proximate to an end of side horizontal support pole 320, and a corresponding hole or other recess is made proximate to the end of rear horizontal support pole 330. These recesses are sized to receive a pin 350, which is friction fit into at least one of the recesses. Pin 350 may comprise a dowel made of wood (e.g., oak, ironwood, lignum vitae, etc.), metal (e.g., titanium, aluminum, stainless steel, etc.), plastic (PVC, UHMW plastic, polyethylene, etc.). Pin 350 forms a hinge around which rear horizontal support pole 330 may be moved with respect to side horizontal support pole 320. In some embodiments, at least one end of pin 350 may be swaged, hammered, machined, or otherwise flared so as to reduce the likelihood that pin 350 will work free during use. Pin 350 allows rear horizontal support pole 330 to be moved to either side of barrier 300, thus allowing the user to deploy fabric 312 on either the user's left-hand or right-hand side. In some embodiments, multiple barriers 300 may be employed to provide the user with privacy and isolation on both sides.

In some embodiments, the hole in at least one of rear horizontal support pole 330 and side horizontal support pole 320 may be threaded. For the purposes of clarity, the term threaded is intended to include not only materials into which threads are cut, tapped, machined, cast, 3-D printed, or otherwise embedded, but also materials into or onto which a threaded nut, threaded insert, or the like has been glued, molded, or otherwise affixed thereto or therein. Where only one of the support poles is threaded, a screw, threaded rod, bolt, or other threaded component may be passed through; affixed to; molded, 3-D printed onto, or machined into; or otherwise mechanically associated with the non-threaded support pole. The support pole to which the threaded component is mechanically associated can then be mated to the threaded support pole, with the threaded component forming a hinge around which rear horizontal support pole 330 may be moved. Where both support poles are threaded, a screw, threaded rod, bolt, or other threaded component may be passed through both support poles. In some embodiments, it may be advantageous to glue or otherwise permanently affix the threaded component into one of the support poles so the threaded component is less likely to work free during use.

In the illustrated embodiment, rear horizontal support pole 330 is designed to be less than the width of a typical coach-class airline seat or other mass-transit seat. The longer rear horizontal support pole 330, the more barrier 300 will resist lateral movement (e.g., tipping) while in use. In addition, making rear horizontal support pole 330 longer has the added advantage of allowing it to be tucked between the user's seat and the seatback, thereby providing additional stability to barrier 300. In the illustrated embodiment, rear horizontal support pole 330 is typically between fourteen (14) and twenty (20) inches long. However, it should be apparent to one skilled in the art that the length of rear horizontal support pole 330 may be varied without departing from the spirit or the scope of the disclosure, and may be advantageous where barrier 300 is intended for use primarily in other environments, such as schools or testing facilities.

In the illustrated embodiment, side horizontal support pole 320 is designed to be approximately the depth of a typical coach-class airline seat or other mass-transit seat. The longer side horizontal support pole 320, the more privacy and isolation barrier 300 is capable of providing for its user when material 312 is employed. However, in some embodiments, it may be advantageous to limit the length of side horizontal support pole 320 so as to not obstruct fellow passengers or others as they pass in front of the user. In the illustrated embodiment, side horizontal support pole 320 is typically between twelve (12) and twenty-four (24) inches long, but one skilled in the art should appreciate that the length may be varied without departing from the spirit or the scope of the disclosure.

Barrier 300 can allow a user to obtain a desired level of privacy and isolation by deploying fabric 312. In the embodiment illustrated in FIG. 11, fabric 312 is supported by upper vertical support pole 370 and lower vertical support pole 310, with the help of hinge 360, when deployed. Upper vertical support pole 370 and lower vertical support pole 310 may also be referred to herein as sub-support poles. Fabric 312 may be removably or permanently affixed to one or both of the vertical support poles. In some embodiments, at least one of side horizontal support pole 320, lower vertical support pole 310, and upper support pole 370 may be significantly shorter than as described above. In such embodiments, if fabric 312 has boning or other structural reinforcements attached thereto or integrated therein, then the support provided by side support pole 320, lower vertical support pole 310, and upper support pole 370 may not be as necessary.

In embodiments where barrier 300 is intended for "one time use", such as where barrier 300 is distributed at a testing center during a test or provided by a mass transportation carrier free of charge (e.g., to improve passenger comfort or to relieve passenger angst), permanent mounting of the fabric may be advantageous for manufacturing and distribution purposes. Similarly, where the barrier is intended for one time use, a single vertical support pole may be substituted for the plurality of poles in the illustrated embodiment.

Where barrier 300 is intended for use by a single user, or where it may be desirable to permit a user or the barrier owner to remove and replace fabric 312, fabric 312 may be temporarily affixed to the support poles by way of hook and loop fasteners, ties, snaps, or the like. By allowing such removal and replacement, the user may, for example, coordinate fabric 312 with their clothing, match the fabric to the user's desired style, celebrate a holiday, include a photograph of a loved one, or the like. As discussed above, the material from which fabric 312 is manufactured can be varied based on attributes desired by the user and the particular use case. By way of example, without limitation, a user may desire that fabric 312 comprise a silk print onto which an antibacterial or antimicrobial coating has been placed.

In the illustrated embodiment, fabric 312 is pleated or otherwise textured so that it folds into a compact shape when stowed while still allowing the fabric to expand to an intended size and shape when in use. In embodiments in which at least one of side horizontal support pole 320, upper vertical support pole 370, and lower vertical support pole 310 comprise a rectangular cross-section, it may be advantageous for the width of the pleats to be equal to or less than the width of at least one of the support poles. Such an arrangement can allow the support pole to provide some protection to fabric 312 when barrier 300 is stowed.

As illustrated in FIG. 12, in some embodiments fabric 312 may detach from at least one of upper vertical support pole 370 and lower vertical support pole 310 to facilitate stowing of barrier 300. When stowed, fabric 312 may be tucked or folded under side horizontal support pole 320, as illustrated in FIGS. 12 and 13, may be folded over upper vertical support pole 370 (not illustrated), or may be removed from the support poles and stowed separately therefrom. In embodiments where fabric 312 has the ability to stretch or flex, or where a flexible coupling is used to attach fabric 312 to one or more of the vertical support poles, detaching of fabric 312 from one or more of the vertical support poles may not be necessary. A band, strap, or other device (not illustrated) may also be included to keep fabric 312 and the support poles tightly closed.

The embodiment illustrated in FIGS. 11-13 includes a plurality of poles hingedly coupled because such an arrangement allows the barrier to be more easily transported and stowed (e.g. in a carrying bag) in the overhead compartment or under the seat in front of the user on an airplane when barrier 300 is not in use. Although hinge 360 is illustrated as a flush-type hinge which is glued, screwed, or otherwise affixed to each of the vertical sub-support poles, other embodiments employ alternative hinge types, including, without limitation, living hinges, barrel hinges, butt hinges, T-hinges, strap hinges, Soss hinges, or the like. In some embodiments, hinge 360 may be adjustable, so that the user can set the amount of friction associated therewith. This can allow the user to be comfortable that the hinge will not allow the vertical sub-support poles to collapse while in use. In addition, magnets may be embedded in the ends of the vertical sub-support poles, snaps or hook and loop straps may connect the vertical support poles, or other such mechanisms may be employed to essentially lock the vertical support poles in alignment with each other. Although illustrated as a plurality of sub-support poles which are hingedly coupled, other embodiments include alternative sub-support pole arrangements, including, without limitation, telescoping poles, poles which have a male/female type connection (e.g., elastic-cored poles used for tents), and the like.

Vertical support pole 310 (or the single vertical support pole in embodiments which employ such support poles) is hingedly coupled to side horizontal support pole 320 by way of hinge 340. Referring to FIG. 12, in the illustrated embodiment, hinge 340 is attached to the support poles by way of screws 345. In the embodiment illustrated in FIGS. 11 and 12, a spacer block 347 is used to offset hinge 340 above side horizontal support pole 320, thereby allowing barrier 300 to close more compactly while still allowing fabric 312 to extend proximate to hinge 340.

Although illustrated with spacer block 347 and screws 345 as an attachment means, alternative attachment or fastening means and arrangements may be substituted therefor without departing from the spirit or the scope of the disclosure. By way of example, without limitation, rather than hinge 340, one of side horizontal support pole 320 and lower vertical support pole 310 may include a recess, hole, rabbet, dado, mortise, or other such notch which is capable of receiving a corresponding component in the other piece. As a further illustration of this concept, an embodiment may comprise a plurality of PVC pipes having a nominal outer diameter of three quarters of an inch, with lower vertical support pole 310 being joined to upper vertical support pole 370 by way of a PVC coupler having a nominal inner diameter of three quarters of an inch. The lower end of lower vertical support pole 310 may mate with side horizontal support pole 320 by way of a tee joint. In such an embodiment, side horizontal support pole 320 may comprise a plurality of sub-poles which are joined by at least one tee and/or at least one coupler. In such an embodiment, pin 350 may be replaced with a ninety degree joint. In some embodiments, the couplers, joints, and tees may be permanently affixed to at least one of the components to which they mate to streamline the assembly and disassembly/stowing process. As a further example, carbon fiber, Kevlar, fiberglass, or other rods with ferules on at least one end thereof and a shock cord core running therethrough, such as those used for making easily collapsible tents, and their correspondingly sized joins, may be substituted for the PVC pipes described above.

In some embodiments, it may be advantageous for hinge 340 to have limited travel (e.g., to travel only through approximately ninety or one hundred twenty degrees) and/or to be adjustable so that the amount of friction, and thus the force required to cause hinge 340 to move, can be set by the user. The use of an adjustable hinge can allow barrier 300 to remain essentially locked or fixed in the deployed position even when bumped or otherwise jostled while in use. In addition, straps or other mechanisms may be connected between side horizontal support pole 320 and at least one of the vertical support poles 370, 310 to further "lock" the vertical support poles into the deployed position.

In the embodiment illustrated in FIG. 12, hinge 340 and spacer block 347 are positioned approximately three to six inches away from the rear end of side horizontal support pole 320. This allows a seatbelt or other restraint to be employed without interference by barrier 300. Where hinge 340 is offset in this manner, gap 380 may not be necessary or advantageous. Alternatively, gap 380 may be extended, or positioned higher or lower, to allow the user to utilize an arm rest, stretch, access dropped items, or the like. In embodiments which are intended for use in vehicles which do not regularly employ seatbelts (e.g., buses, subways, ferries, etc.) or where seatbelt use isn't an option (e.g. schools, testing environments, etc.), it may be advantageous to position hinge 340 closer to the rear of side horizontal support pole 320 and/or to avoid the use of gap 380.

The embodiment illustrated in FIGS. 11-13 is intended for frequent transportation, and thus temporary or permanent attachment means are not illustrated because their use would slow the deploying and stowing of barrier 300. However, in some embodiments it may be advantageous to utilize straps, snaps, clamps, velcro or other hook and loop attachment, or other temporary or permanent attachment techniques to affix barrier 300 to the chair, seat, or other space to be occupied by the user.

Figure 14:
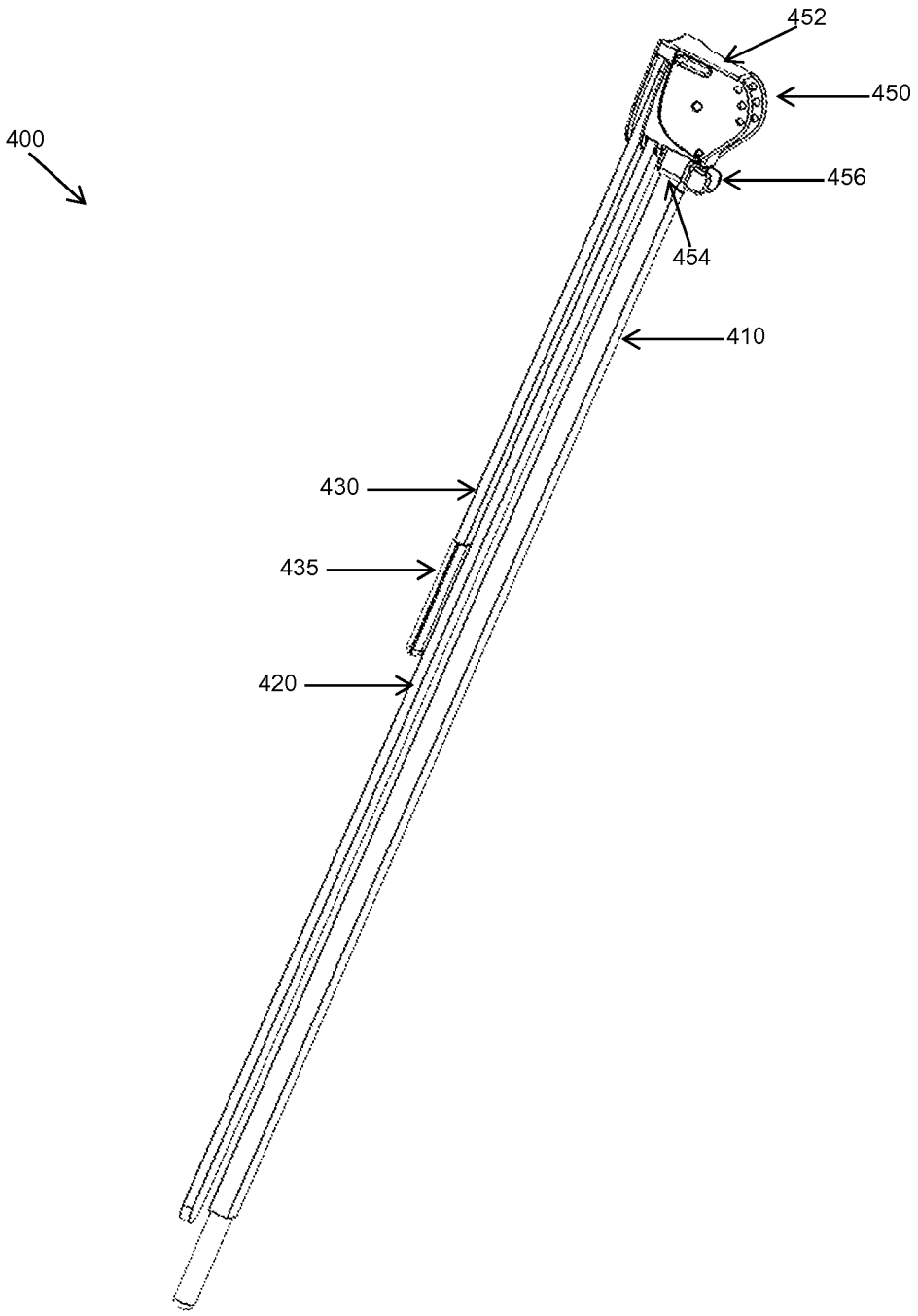
FIG. 14 is a perspective view of a portable personal seating barrier with three support poles in a closed position, in accordance with an embodiment.

FIGS. 14-18 illustrate an alternative embodiment of a barrier 400. FIG. 14 illustrates barrier 400 in a closed position and, for the purposes of clarity, the fabric that creates the physical barrier proximate to the user has been omitted. When in use barrier 400 is similar to barrier 300 described above, and the fabric that would be used in the embodiment illustrated in FIGS. 14-18 is similar to fabric 312. Barrier 400 comprises four main components, rear horizontal support pole 430, side horizontal support pole 420, vertical support pole 410, and hub 450. As will be described in more detail below, in the illustrated embodiment hub 450 is designed to receive and mate with an end of each of rear horizontal support pole 430, side horizontal support pole 420, and vertical support pole 410.

In the illustrated embodiment, the support poles are made from polyethylene which as a rectangular cross-section and is approximately ¾" wide and between ¼" and ¾" thick. Rear horizontal support pole 430 is between approximately twelve (12) and twenty (20) inches long. Side horizontal support pole 420 is between approximately sixteen (16) and thirty (30) inches long. Vertical support pole 410 is between eighteen (18) and forty (40) inches long. Although not illustrated in the embodiment of FIG. 14, in some embodiments, at least one of the support poles may be collapsible (e.g., by telescoping, folding by way of a hinge, male and female connectors, threaded joints, or the like) so as to facilitate stowing of barrier 400.

The end of rear horizontal support pole 430 which is opposite hub 450, and the end of vertical support pole 410 which is opposite hub 450, may have a protective cover 435 stretched thereover, sprayed onto, or otherwise applied thereto. Such a cover 435 may be textured with or manufactured of a material that has a slightly adhesive feel associated therewith, such as, without limitation, silicone. Such materials can help keep rear horizontal support pole 430 from moving when deployed. Cover 435 can also comprise neoprene, foam, or other such soft materials to lessen the likelihood of barrier 400 causing discomfort for the user or someone seated proximate thereto. In some embodiments, the ends of one or both of rear horizontal support pole 430 and vertical support pole 410 may be machined, cast, 3-D printed, or otherwise manufactured so as to have a circular cross-section and/or rounded ends, thereby further blunting the ends.

Hub 450 is designed such that side horizontal support pole 420 stays relatively fixed therein. Hub 450 allows rear horizontal support pole 430 to rotate through approximately one hundred eighty (180) degrees, and allows horizontal support pole 430 to be locked in position when rear horizontal support pole 430 is essentially parallel with side horizontal support pole 420 (i.e., in the position it would occupy when barrier 400 is ready to be stowed), and when rear horizontal support pole 430 is approximately perpendicular to side horizontal support pole 420 (i.e., in the deployed position). Hub 450 also allows vertical support pole 410 to be locked in the closed position (i.e., approximately parallel to side horizontal support pole 420), and in a plurality of open positions. Such open positions may include, but are not limited to, perpendicular to side horizontal support pole 420 (i.e., approximately 90 degrees from side horizontal support pole 420), approximately 113 degrees from side horizontal support pole 420, and approximately 135 degrees from side horizontal support pole 420.

Figure 15:
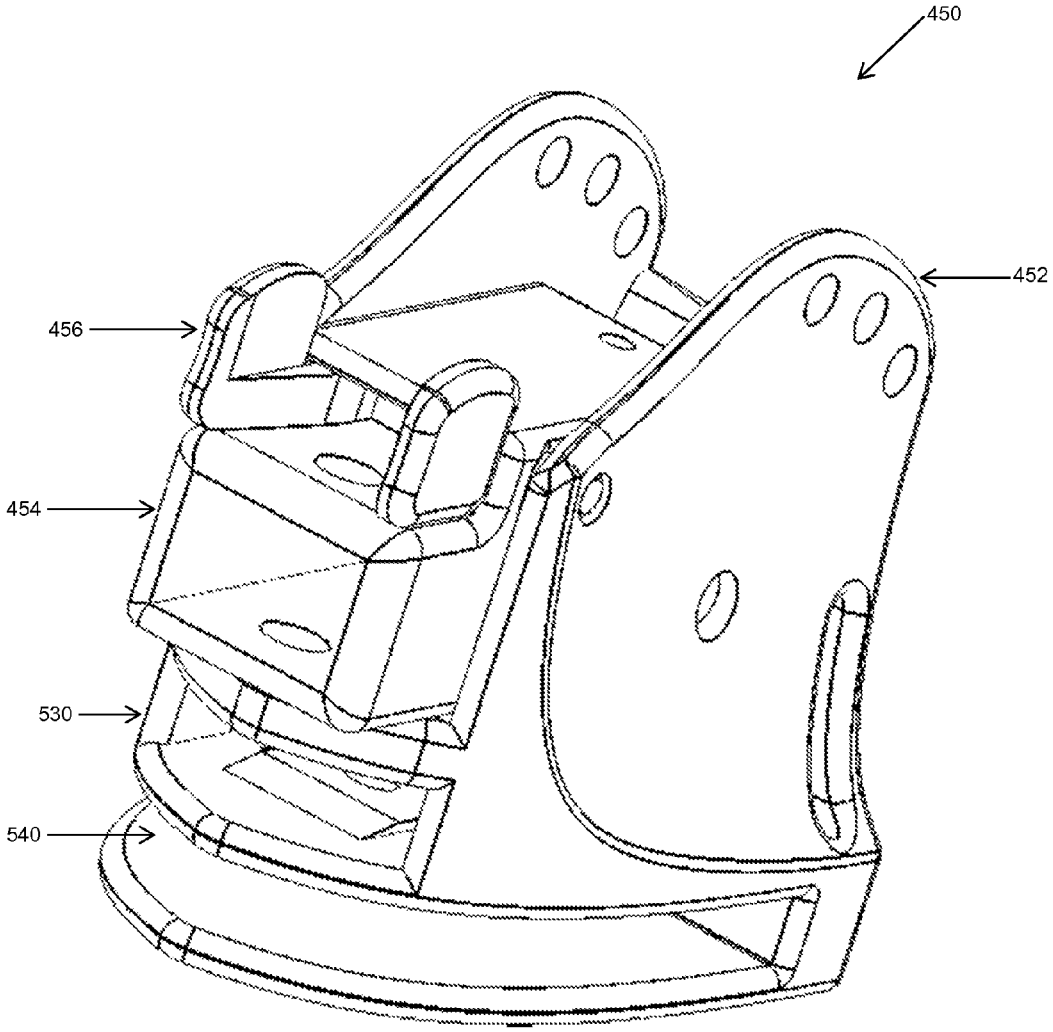
FIG. 15 is a detailed perspective view of the hinge used in the portable personal seating barrier of FIG. 14.
Figure 16:
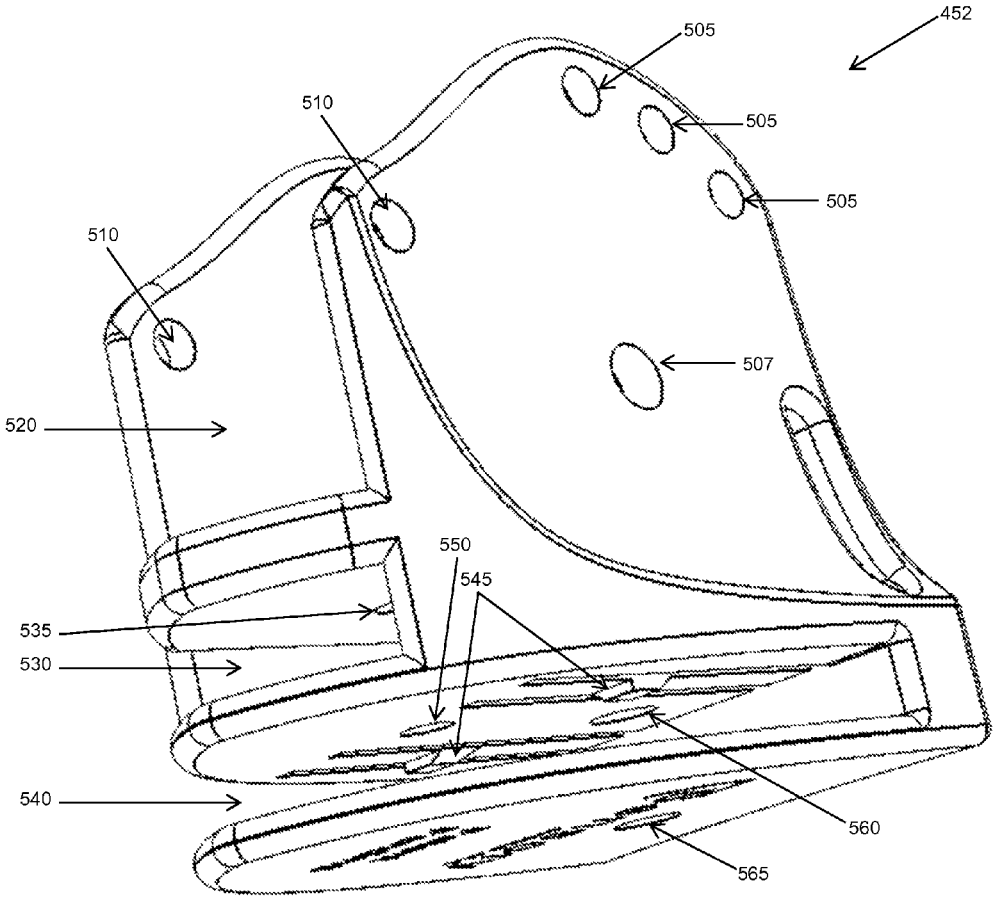
FIG. 16 is a detailed perspective view of the base of the hinge illustrated in FIG. 15.

FIG. 15 is a detailed upper perspective view of an embodiment of hub 450. As illustrated, hub 450 comprises base 452, lug 454, and spring 456. FIG. 16 is a detailed lower perspective view of base 452 from which lug 454 and spring 456 have been removed. When employed in use, an end of side horizontal support pole 420 is inserted into cavity 530 and a pin, dowel, screw, or other such device is passed through hole 535, into a corresponding hole in side horizontal support pole 420, and into hole 550 thereby locking horizontal support pole 420 therein. In some embodiments, side horizontal support pole 420 may be integral to hub 450 (e.g., manufactured as part of hub 450) or side horizontal support pole 420 may be affixed within cavity 530 by way of one or more adhesives. In the illustrated embodiment, cavity 530 is designed so as to keep side support pole 420 relatively fixed with respect to hub 530.

An end of rear horizontal support pole 430 is inserted into horizontal cavity 540, and a pin, dowel, screw, bolt, or other such device is passed through hole 565, through a corresponding hole in rear horizontal support pole 430, and into hole 560. This device serves as a hinge around which rear horizontal support pole 430 can be rotated. Horizontal cavity 540 is designed so as to limit rear horizontal support pole to moving in approximately a single plane, the plane being roughly parallel to the seat occupied by the user when barrier 400 is in use. Body 452 further comprises fingers 545 into which extensions are molded, machined, 3-D printed, or otherwise attached. Fingers 454 are separated by approximately ¾", and the extensions engage rear horizontal support pole 430 so that it is trapped therebetween when barrier 400 is ready for stowing. Fingers 454 are designed so as to be flexible, and the sides of the extensions are machined so as to have rounded or angled profiles. When the user grasps side horizontal support pole 420, hub 450, or a combination thereof and applies lateral pressure to rear horizontal support pole 430, this causes pressure to be applied to one of the extensions, which in turn causes the corresponding finger to deform. The deformation causes the extension to lift sufficiently clear of cavity 540 so as to allow rear horizontal support pole 430 to move within cavity 540 in the direction of the extension onto which pressure was applied. The extensions are also positioned approximately ¾" from the rear wall of cavity 540. This allows rear horizontal support pole 430 to be trapped between the rear wall and an extension, thereby essentially locking rear horizontal support pole 430 in the deployed position. As described above, when sufficient pressure is applied to rear horizontal support pole 430, the extension lifts sufficiently clear of cavity 540 so as to allow rear horizontal support pole 430 to move therein.

Figure 17:
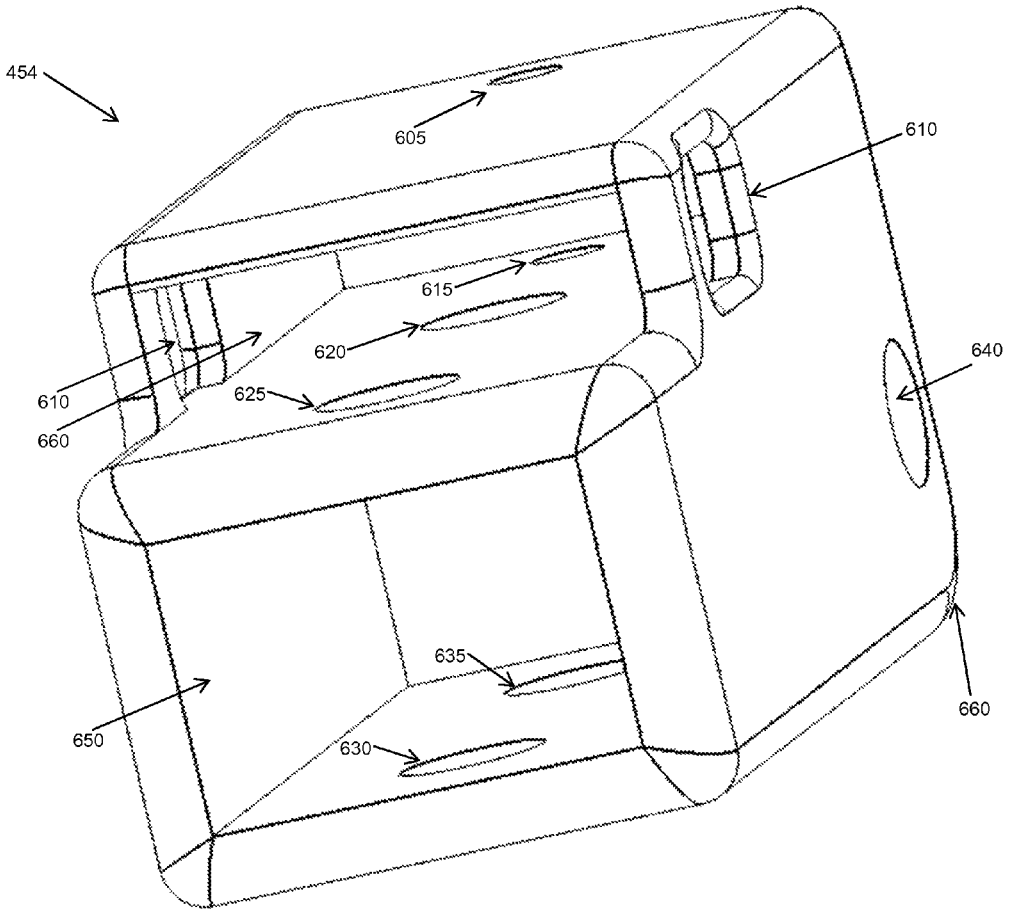
FIG. 17 is a detailed perspective view of the lug portion of the hinge illustrated in FIG. 15.

FIG. 17 is a front perspective view of lug 454. Lug 454 can be mated with base 452 of FIG. 16 by inserting a pin, dowel, screw, bolt, or other such device into hole 507 of FIG. 16, though lug 454 by way of hole 640, and into a hole on the opposite side of base 452. This device forms a hinge around which lug 454 can rotate within base 452. Corners 660 and the bottom rear edge of lug 454 are rounded or otherwise angled so as to facilitate this rotation.

In the embodiment illustrated in FIG. 17, an end of vertical support pole 410 is inserted into cavity 650. A first pin, dowel, screw, bolt, or other device can be inserted into hole 635, passed through a corresponding hole in vertical support pole 410, and then into hole 620. A second pin, dowel, screw, bolt, or other device can be inserted into hole 630, passed through a corresponding hole in vertical support pole 410, and then into hole 625. These first and second devices allow vertical support pole 410 to be positively mated with lug 454. Although illustrated as using a plurality of devices to facilitate the locking, some embodiments employ alternative locking techniques, including, without limitation, using only a single device; using an adhesive; chemical, thermal, or ultrasonic welding, or the like. Similarly, although lug 454 is illustrated as being separate from vertical support pole 410, in some embodiments the equivalent portions of lug 454 may be machined into, cast as part of, 3-D printed along with, or otherwise manufactured into vertical support pole 420.

Figure 18:
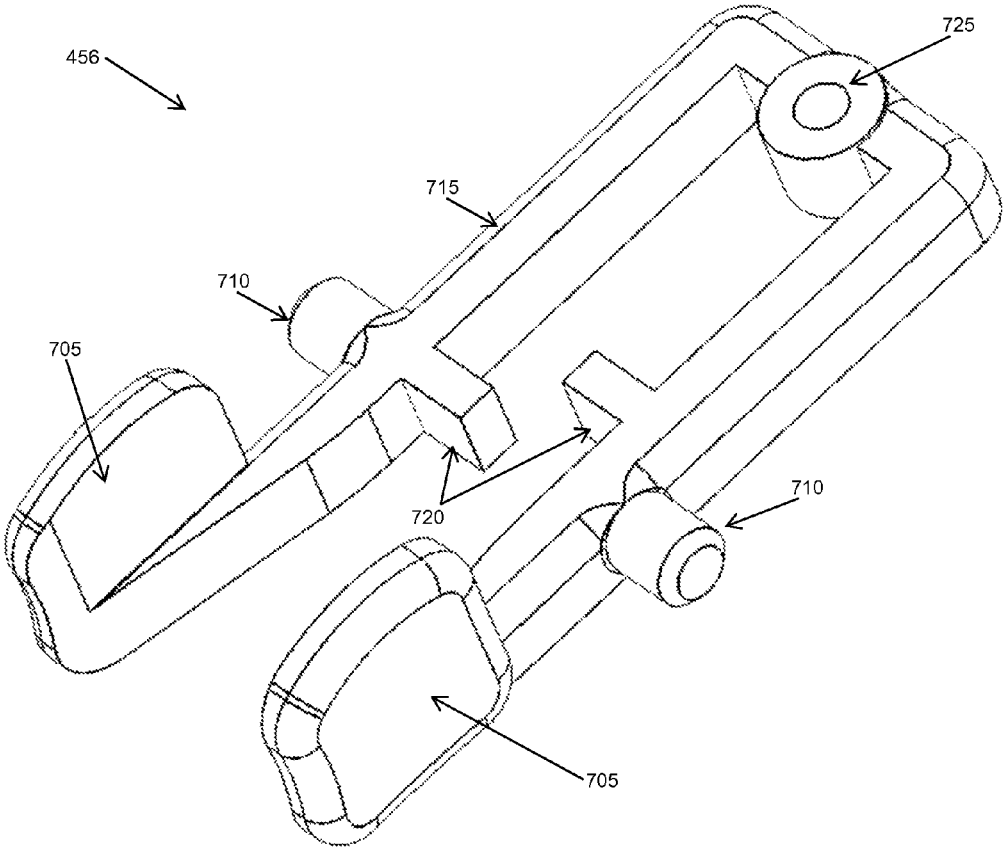
FIG. 18 is a detailed perspective view of the spring mechanism of the hinge illustrated in FIG. 15.

FIG. 18 is a perspective view of spring 456. In use, pins 710 of spring 456 engage with holes 505 and 510 of base 452 (illustrated in FIG. 16), thereby locking vertical support pole 410 in a deployed position. By applying pressure to wings 705 so as to move wings 705 closer to each other, pins 710 can be pulled from within holes 505 and 510, thereby allowing vertical support pole 410 to be deployed or stowed as desired. The illustrated embodiment of spring 456 also includes extensions 720, which keep the user from applying unnecessary pressure to spring 456 and help lengthen the lifespan of spring 456.

The end of spring 456 comprising hole 725 is inserted into cavity 660 of lug 454 (illustrated in FIG. 17). A pin, dowel, screw, bolt, or other such device is passed through hole 605 of lug 454, through hole 725 of spring 456, and into hole 615, thereby locking spring 456 within lug 454. Pins 710 extend through holes 610 so that the pins can engage the corresponding holes in body 452. Although illustrated as locked into lug 454 by way of the device passed through holes 605, 615, and 725, in some embodiments adhesives, chemical, thermal, or ultrasonic welding, or other such techniques may be used to bond or otherwise lock spring 456 into lug 454.

As described above with respect to the other embodiments, although the embodiment illustrated in FIGS. 14-18 is primarily designed for use in mass transportation or other such environments where rapid deployment and stowing of barrier 400 is advantageous, barrier 400 may also be equipped with or facilitate the use of clamps, hook and loop closures, pins, bolts, or other such attachment means, thereby allowing barrier 400 to remain temporarily or permanently affixed to or otherwise associated with a particular seat.

While various embodiments of a personal barrier have been described in detail herein, it will be apparent to those skilled in the art that various changes and modifications can be made thereto without departing from the spirit and scope of the described embodiments. Thus, it is intended that the instant disclosure cover such modifications and variations, and that such modifications and variations are intended to fall within the scope of the appended claims and their equivalents.

The invention claimed is:

1. A personal barrier comprising:

a rear horizontal support pole;

a side horizontal support pole, the side horizontal support pole being hingedly attached to the rear horizontal support pole, the hinged attachment of the side horizontal support pole and the rear horizontal support pole allowing the rear horizontal support pole to rotate with respect to the side horizontal support pole and define a first plane, the first plane comprising a bottom of a space to be occupied by a user of the personal barrier;

a vertical support pole, the vertical support pole being hingedly attached to the side horizontal support pole, the hinged attachment of the vertical support pole to the side horizontal support pole allowing the vertical support pole to rotate with respect to the side horizontal support pole to define a second plane, the second plane defining a first side of the space to be occupied by a user of the personal barrier; and a barrier comprising a fabric, the barrier being attached to the vertical support pole and the side horizontal support pole, the barrier occupying at least a portion of the first side, wherein the rear horizontal support pole is positioned proximate to the rear of a seat occupied by the user and the side horizontal support pole is positioned proximate to the side of the seat.

2. The personal barrier of claim 1, wherein the vertical support pole comprises a plurality of sub-support poles.

3. The personal barrier of claim 2, the sub-support poles being coupled to each other by way at least one of: at least one hinge, telescopic connection, magnetic coupling, or threaded coupling so as to define the vertical support pole.

4. The personal barrier of claim 1, wherein the hinged attachment of the rear horizontal support pole to the side horizontal support pole comprises at least one of a hinge, a pin, or a threaded coupling.

5. The personal barrier of claim 4, wherein the male component and the female component are both threaded.

6. The personal barrier of claim 5, the removable attachment comprises at least one of a tie, a snap, hook and loop fasteners, and buttons.

7. The personal barrier of claim 1, wherein the hinged attachment of the rear horizontal support pole to the side horizontal support pole comprises a male component associated with one of the rear horizontal support pole and the side horizontal support pole, and a female component associated with the other of the rear horizontal support pole and the side horizontal support pole.

8. The personal barrier of claim 1, wherein the fabric is removably attached to at least one of the vertical support pole and the side horizontal support pole.

9. The personal barrier of claim 1, the fabric being pleated.

10. The personal barrier of claim 1, the rear horizontal support pole being between fourteen and twenty inches long.

11. The personal barrier of claim 1, the vertical support pole being between twenty-four and thirty-six inches long.

12. The personal barrier of claim 1, the side horizontal support pole being between twelve and twenty-four inches long.

13. The personal barrier of claim 1, the hinged attachment of the vertical support pole to the side horizontal support pole allowing the vertical support pole to be proximate to the side horizontal support pole when the personal barrier is in a stowed position, and the hinged attachment of the rear horizontal support pole to the side horizontal support pole allowing the rear horizontal support pole to be proximate to the side horizontal support pole when the personal barrier is in the stowed position.

14. The personal barrier of claim 1 further comprising a spacer block, the spacer block offsetting the hinged attachment point of the vertical support pole from the side horizontal support pole.

15. A personal barrier comprising:

a rear horizontal support pole, the rear horizontal support pole being between fourteen and twenty inches long, between one half of an inch and two inches wide and between one quarter and one inch thick;

a side horizontal support pole, the side horizontal support pole being between eighteen and twenty-four inches long, between one half of an inch and two inches wide and between one quarter and one inch thick;

a first hinge, the first hinge being positioned near a first end of the rear horizontal support pole and a first end of the side horizontal support pole, the hinge allowing the rear horizontal support pole to rotate and define a first plane;

a vertical support pole, the vertical support pole being between twenty-four and thirty-six inches long, between one half of an inch and two inches wide, and between one quarter of an inch and one inch thick;

a second hinge, a first end of the second hinge being attached to the side horizontal support pole between two and six inches from the first hinge, a second end of the second hinge being attached to the vertical support pole, the hinge allowing the vertical support pole to rotate and define a second plane; and a fabric, a first end of the fabric being attached to the vertical support pole, and a second end of the fabric being attached to the side horizontal support pole, the fabric being pleated.

16. The personal barrier of claim 15, the vertical support pole comprising a plurality of sub-support poles, the sub-support poles being coupled to each other by way at least one of: at least one hinge, telescopic connection, magnetic coupling, and threaded coupling.

17. The personal barrier of claim 16, each of the plurality of sub-support poles being between twelve and eighteen inches long.

18. The personal barrier of claim 15, the fabric being removably attached to at least one of the vertical support pole and the side horizontal support pole.

19. The personal barrier of claim 15, the comprising a biologically inhibiting material.

20. The personal barrier of claim 15, the first plane and the second plane being perpendicular to each other.

* * * * *